US005807152A

United States Patent [19]

Wojcik

[11] Patent Number: 5,807,152

[45] Date of Patent: Sep. 15, 1998

[54] SURFBOARD AND METHOD OF MAKING SAME

[76] Inventor: Warren Wojcik, 3102 Alta Vista Dr., Fallbrook, Calif. 92028

[21] Appl. No.: 759,942

[22] Filed: Dec. 3, 1996

Related U.S. Application Data

[63] Continuation-in-part of Ser. No. 598,101, Feb. 6, 1996, abandoned.

[51] Int. Cl.[6] ..... B63B 35/79

[52] U.S. Cl. ..... 441/74; 114/357; 114/270; 114/39.2; 441/79

[58] Field of Search ..... 441/65, 74, 79, 441/129; 440/38; 114/39.2, 357, 270

[56] References Cited

U.S. PATENT DOCUMENTS

| | | | |
|---|---|---|---|
| 2,531,946 | 11/1950 | Parker | 441/74 |
| 2,816,298 | 12/1957 | Foster | 114/357 |
| 3,324,822 | 6/1967 | Carter, III | 440/38 |
| 3,405,677 | 10/1968 | Smith | 114/270 |
| 3,435,470 | 4/1969 | Krenzler | 114/347 |
| 3,663,976 | 5/1972 | Momany | 114/357 |
| 4,021,874 | 5/1977 | Alter et al. | 114/357 |
| 4,274,357 | 6/1981 | Dawson | 114/270 |
| 4,964,825 | 10/1990 | Paccoret et al. | 441/74 |

FOREIGN PATENT DOCUMENTS

| | | | |
|---|---|---|---|
| 3040792 | 8/1982 | Germany | 441/74 |

*Primary Examiner*—Sherman Basinger
*Attorney, Agent, or Firm*—James E. Brunton

[57] ABSTRACT

Lightweight, high-strength flotation devices such as surfboards, sailboard and body boards that can be inexpensively manufactured from plastic sheet materials using thermo-vacuum forming techniques. The devices include specially configured structural cores which provide strength and rigidity to the devices. The structural cores are, in turn, encapsulated between specially configured upper- and lower-shaped panels which add strength to the devices and create a sleek, finished appearance.

18 Claims, 18 Drawing Sheets

SURFBOARD AND METHOD OF MAKING SAME

This is a Continuation-In-Part of application, Ser. No. 08/598,101 filed Feb. 6, 1996 now abandoned.

BACKGROUND OF THE INVENTION

1. Field of the Invention

The present invention relates generally to surfboards. More particularly, the invention concerns novel, lightweight surfboards which can be manufactured using thermo-vacuum forming techniques.

2. Discussion of the Invention

For many years, surfboards have been hand shaped from various lightweight flotation materials. First, redwood, then balsa wood was used to construct the surfboards. The most common materials presently being used for surfboard construction include polyurethane and polystyrene foam. Typically, the foam is formed into an elongated block which is then hand shaped to form a shaped substrate. The substrate is then covered by a lamination typically comprising fiberglass cloth and polyester or epoxy resin.

Another relatively common type of prior art surfboard is the so-called hollow-hull surfboard. Such surfboards typically include a plurality of supporting struts or corrugated inner structures which support an outer skin or surface layer. The principal drawback of this type of surfboard is the substantial combined weight of the corrugated structure and outer skin which, of course, must safely support the weight of the surfer.

Prior art surfboards typically exhibit a shape characterized by a relatively thick mid-section for flotation and strength, which tapers downwardly to form the tail portion of the surfboard. Such a shape is well suited for foam-core type structures. On the other hand, such a shape is not well suited for hollow-hull surfboards which need to be relatively thin to provide sufficient strength and minimize overall weight. Accordingly, hollow-hull surfboards often exhibit relatively poor flotation characteristics.

As a general rule, prior art surfboards are provided with one or more fins typically made of laminated fiberglass and epoxy or polyester resin. As a general rule, the prior art "long boards" are provided with one relatively large central trailing fin and two smaller side fins. The prior art "short boards", on the other hand, usually have one small central trailing fin and two small side fins. In either case, the side fins are used for turning the board and the trailing fin is used for stabilization.

Prior art surfboard designs of the character described in the preceding paragraphs exhibit several drawbacks. For example, the foam core type surfboards are generally difficult and expensive to fabricate in volume since the manufacturing process is highly labor intensive. These types of surfboards are also easily damaged in use and once damaged, are difficult and costly to repair.

The prior art hollow core type surfboards are also typically expensive to make and frequently exhibit undesirable flotation characteristics. Once damaged, these type of boards are also difficult and expensive to repair.

Another drawback exhibited by many prior art surfboards relates to the design of the steering and stabilization fins which are provided on the undersurface of the board. As previously mentioned, the prior art surfboards are typically provided with either a single, substantially rigid center fin, or are provided with a relatively large center fin and two transversely spaced-apart side fins. The center fin is supposed to act as a stabilization fin while the side fins are provided for turning. However, in practice many of the prior art fin constructions do not function well and often are hazardous to the user as well as to other nearby surfers.

As will become apparent from the discussion which follows, the surfboard design of the present invention uniquely overcomes many of the drawbacks of the prior art by providing a unique board design as well as a unique combination stabilization and turning fin. Since the surfboard of the present invention can be constructed using simple thermo-vacuum forming techniques, it can be very inexpensively constructed and provides a lightweight, highly durable surfboard with excellent flotation characteristics.

SUMMARY OF THE INVENTION

It is an object of the present invention to provide a novel surfboard which is of a lightweight, high-strength construction that can be inexpensively manufactured from plastic sheet materials using thermo-vacuum forming techniques.

Another object of the invention is to provide a surfboard of the aforementioned character which includes a novel fin arrangement that positively stabilizes the board and also provides excellent turning characteristics. More particularly, the fin construction comprises a whip-like extension which assists in turning the board and then returns to a straight configuration to automatically return the board to straight line travel.

Another object of the invention is to provide a novel surfboard and the method of making the same in which the surfboard exhibits superior flotation characteristics making it easy to use and providing excellent performance characteristics.

Another object of the invention is to provide a method for making a lightweight surfboard in which a first sheet of plastic sheet material is uniquely formed into a ribbed structure and then is sealably encapsulated between second and third, substantially planar shaped plastic sheets to form top and bottom surfaces.

Still another object of the invention is to provide a surfboard of the character described in the preceding paragraphs which is completely recyclable.

Another object of the invention is to provide a flotation device such as a surfboard of the class described in which the upper panel of the device includes a downwardly curved, generally "C" shaped margin to which the lower panel is connected. This construction provides a safe and attractive flotation device having excellent handling characteristics.

DESCRIPTION OF THE INVENTION

Figure 3:
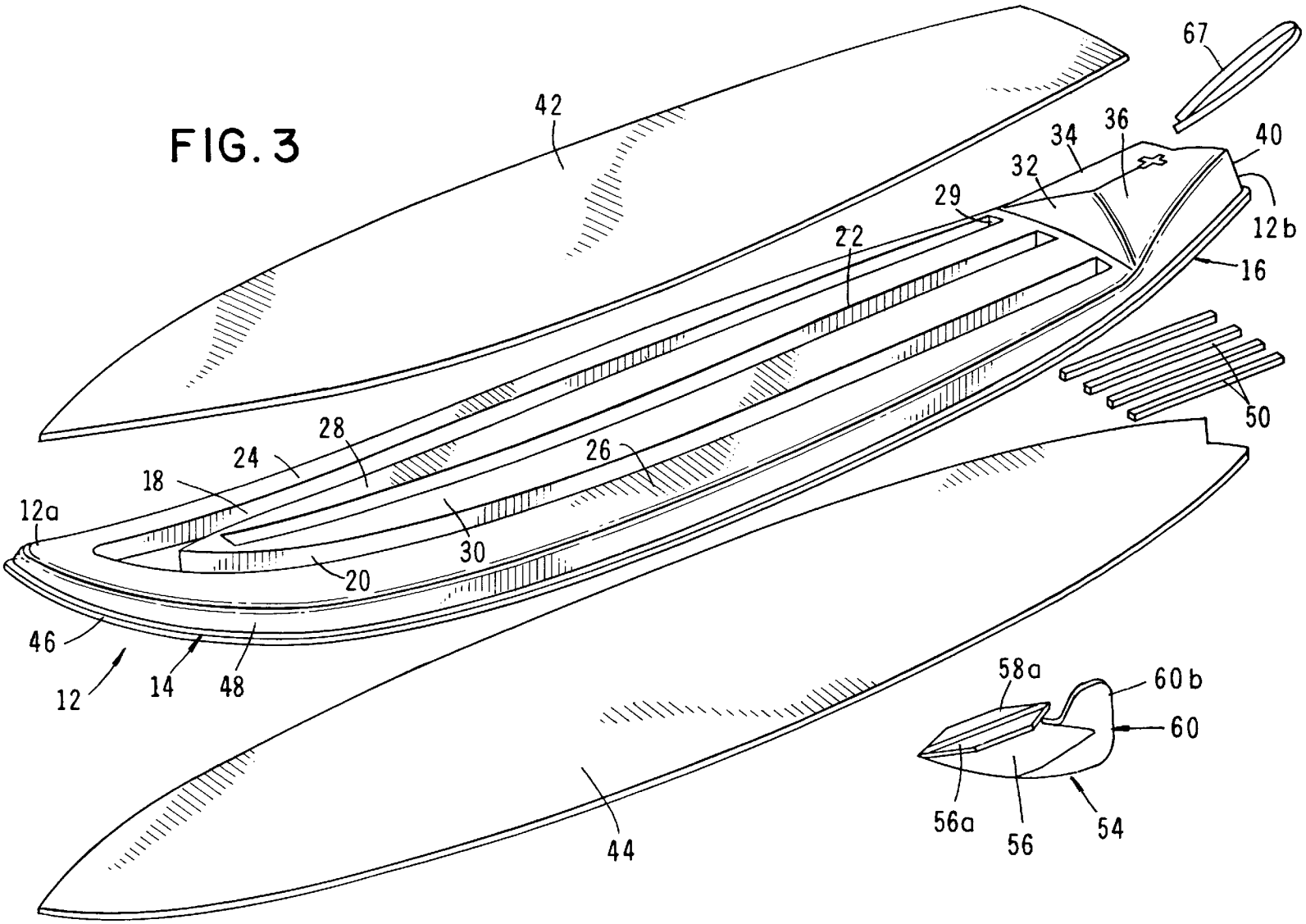
FIG. 3 is a generally perspective exploded view of the surfboard shown in FIGS. 1 and 2.
Figure 4:
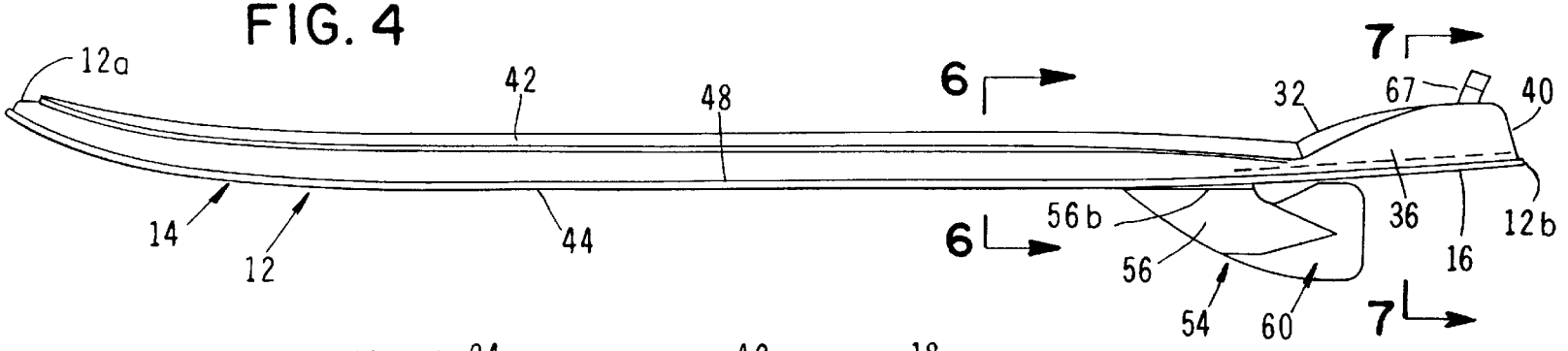
FIG. 4 is a side-elevational view of the surfboard shown in FIGS. 1 and 2.
Figure 5:
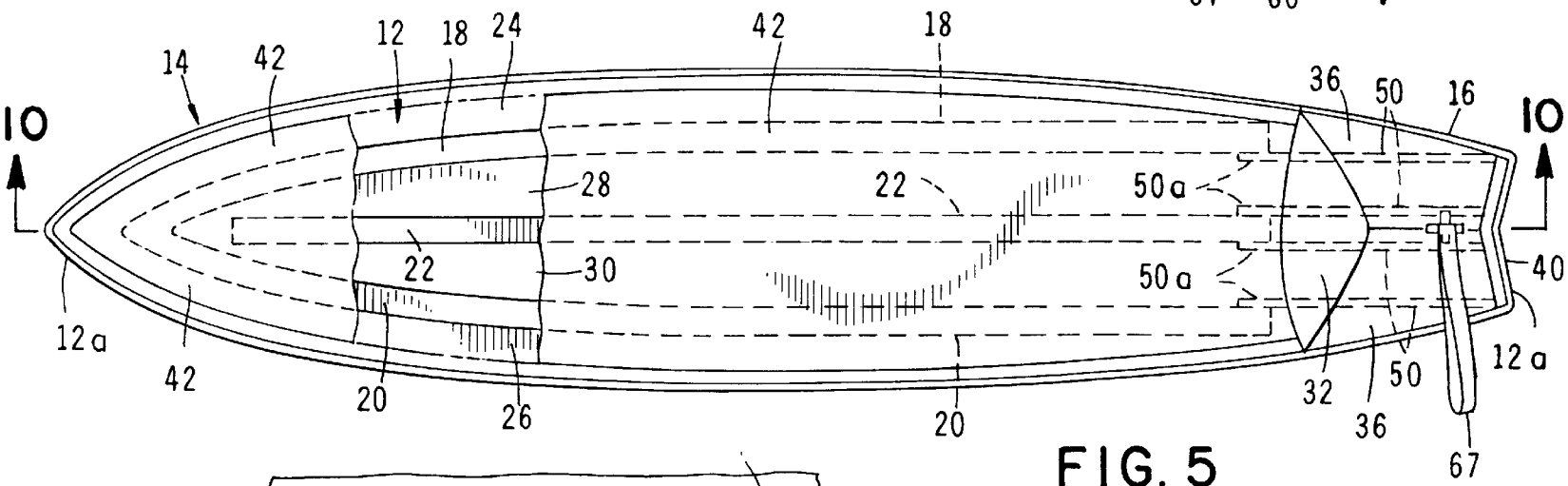
FIG. 5 is a top plan view of the surfboard partly broken away to shown internal construction.
Figure 6:
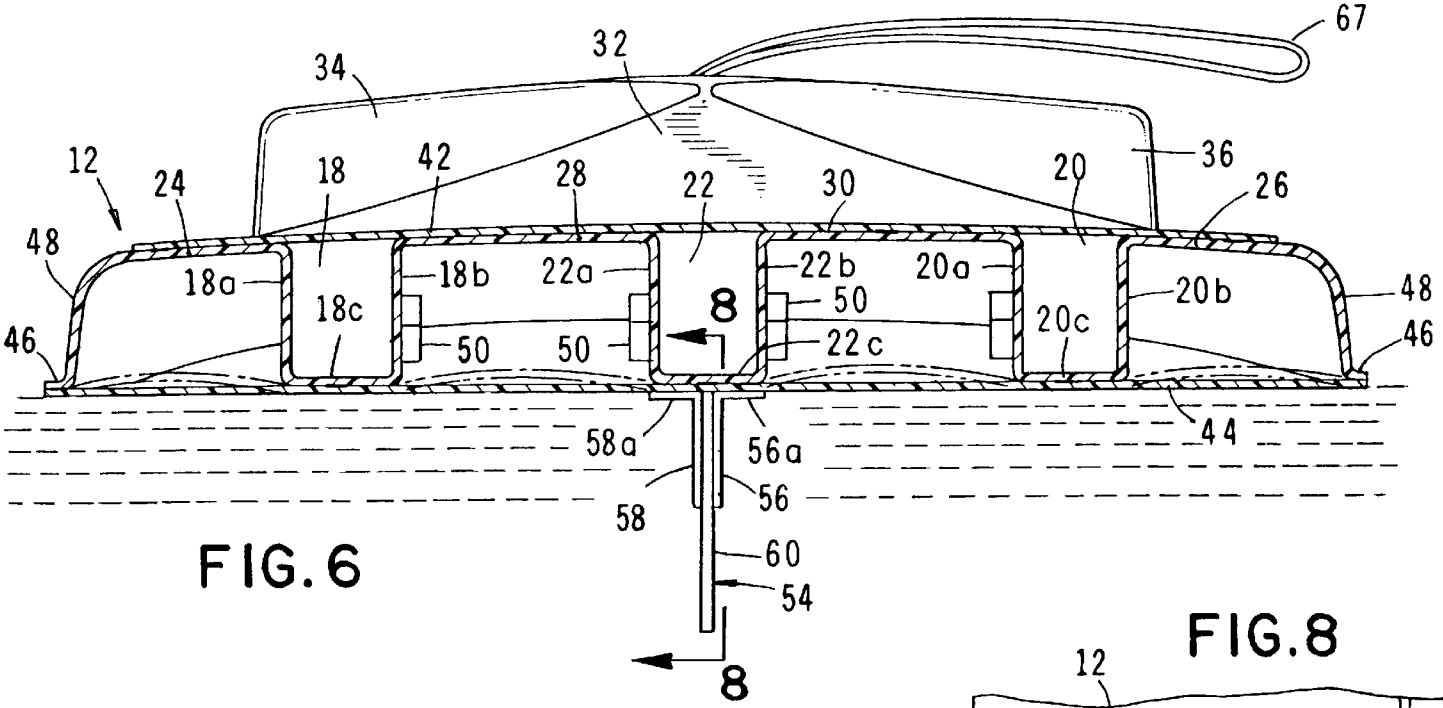
FIG. 6 is a greatly enlarged, cross-sectional view taken along lines 6—6 of FIG. 4.

Referring to the drawings and particularly to FIGS. 1 through 6, one form of the lightweight surfboard of the present invention is there illustrated. The surfboard of this form of the invention comprises a structural reinforcing core 12 having a forward section 14 and a rearward section 16 (FIG. 3). Forward section 14 is provided with first and second longitudinally extending channels 18 and 20 (FIGS. 3 and 6) which are defined by transversely spaced-apart side walls 18*a* and 18*b* and 20*a* and 20*b* respectively. As best seen in FIG. 6, the side walls of the channels are interconnected by integrally formed base walls 18*c* and 20*c* respectively. Also formed in forward section 14 of the structural reinforcing core is a center channel 22 which has side walls 22*a* and 22*b* interconnected by a base wall 22*c*. In addition to channels 18, 20, and 22, forward section 14 of reinforcement core 12 also includes a first upper support surface 24 disposed outboard of channel 18 and a second upper support surface 26 disposed outboard of channel 20. Disposed between side channel 18 and center channel 22 is a third support surface 28 and, disposed between side channel 20 and center channel 22 is a fourth support surface 30. As best seen in FIG. 3, each of the channels terminates at its rearward extremity in an end wall 29 which is provided with a plurality of drain apertures 29*a*.

Figure 13:
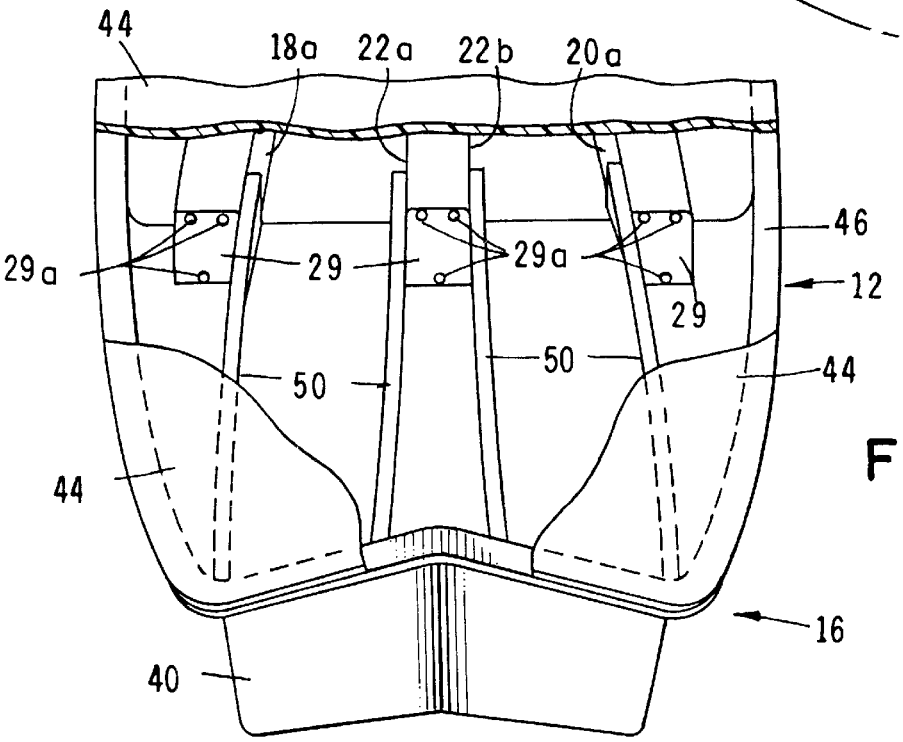
FIG. 13 is an enlarged, fragmentary view of the rear portion of the surfboard viewed from the bottom to illustrate the drain apertures provided in the bottom surface of the surfboard.

Rearward section 16 of structural reinforcement core 12 is upturned in the manner shown in FIG. 3 and includes an inboard end wall 32 to which a pair of downwardly sloping side walls 34 and 36 are interconnected. As best seen in FIGS. 4 and 13, rear section 16 terminates in a angularly, upwardly extending, generally angularly shaped stern wall 40. Overlaying forward section 14 of the structural reinforcement core is a first, or upper panel 42. As indicated in FIG. 6, panel 42 engages support surfaces 24, 26, 28, and 30 and is preferably bonded thereto by sonic bonding or by a suitable adhesive the character of which may vary depending upon the type of plastic material being used to construct the surfboard. In similar fashion, a second or lower panel 44 overlays the bottom of the structural reinforcement core and, as shown in FIG. 6, engages bottom walls 18*c*, 20*c*, and 22*c* of channels 18, 20, and 22. As best seen in FIG. 6, the structural reinforcement core 12 is formed so that marginal flange portions 46 are provided at either side of the core, which flanges comprise the terminal portion of a downwardly extending side walls 48. Side walls 48 circumscribe forward portion 14 and are interconnected at their rearward extremities with stern wall 40 (FIG. 3). Lower panel 44 is affixed at its marginal portions to flanges 46 by any suitable bond such as adhesive bonding.

Figure 7:
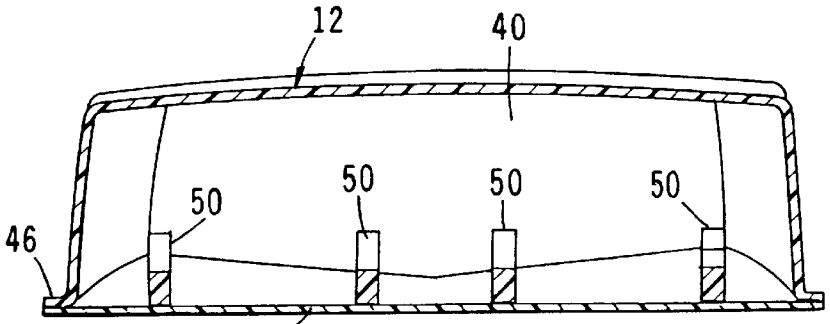
FIG. 7 is a greatly enlarged, cross-sectional view taken along lines 7—7 of FIG. 4.
Figure 10:
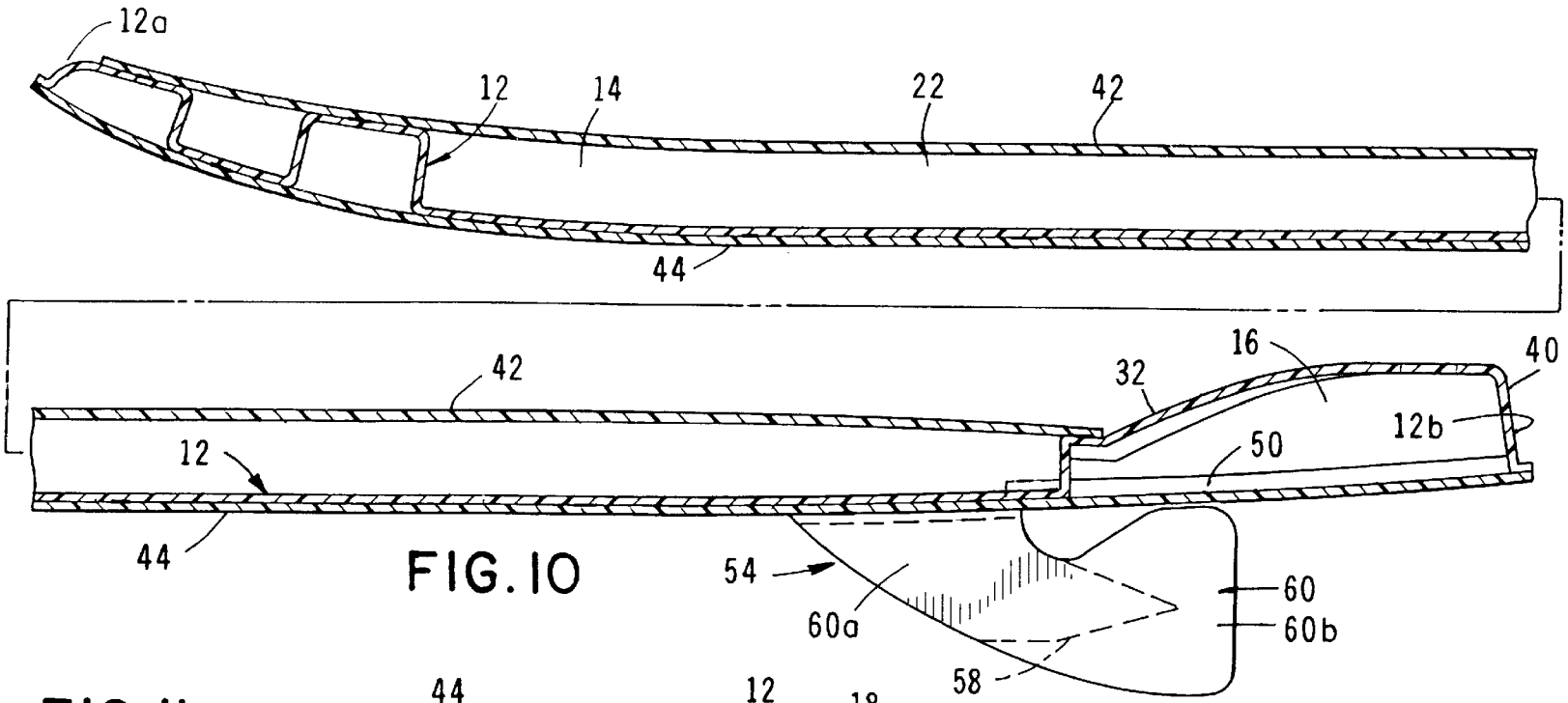
FIG. 10 is a cross-sectional view taken along lines 10—10 of FIG. 5.
Figure 11:
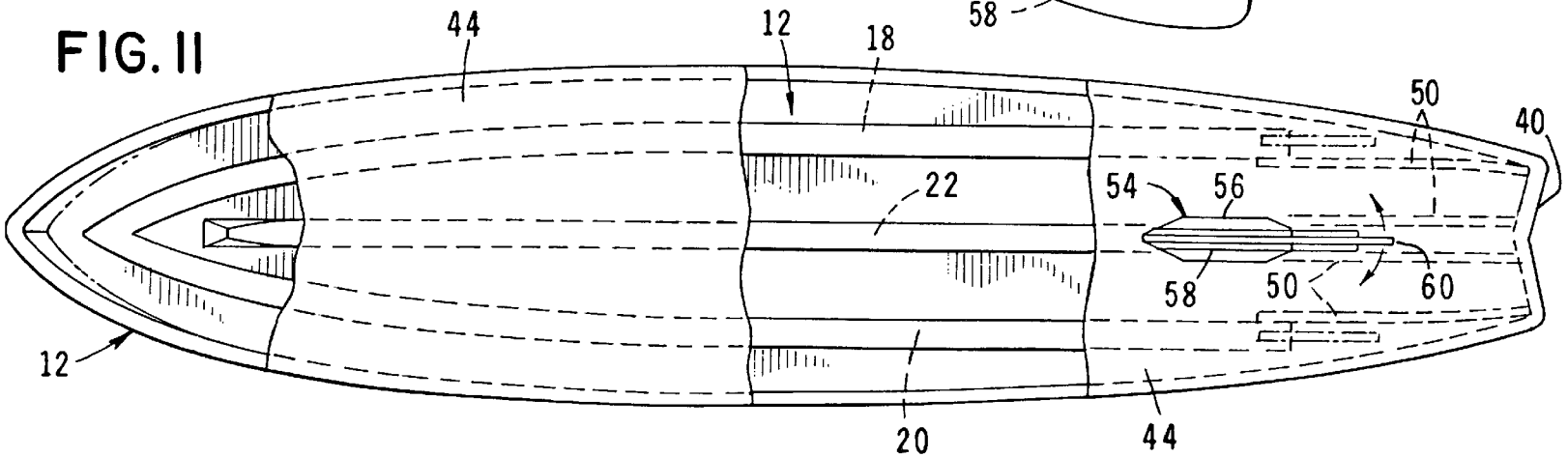
FIG. 11 is a bottom plan view of the surfboard shown in FIGS. 1 and 2 partly broken away to show internal construction.
Figure 12:
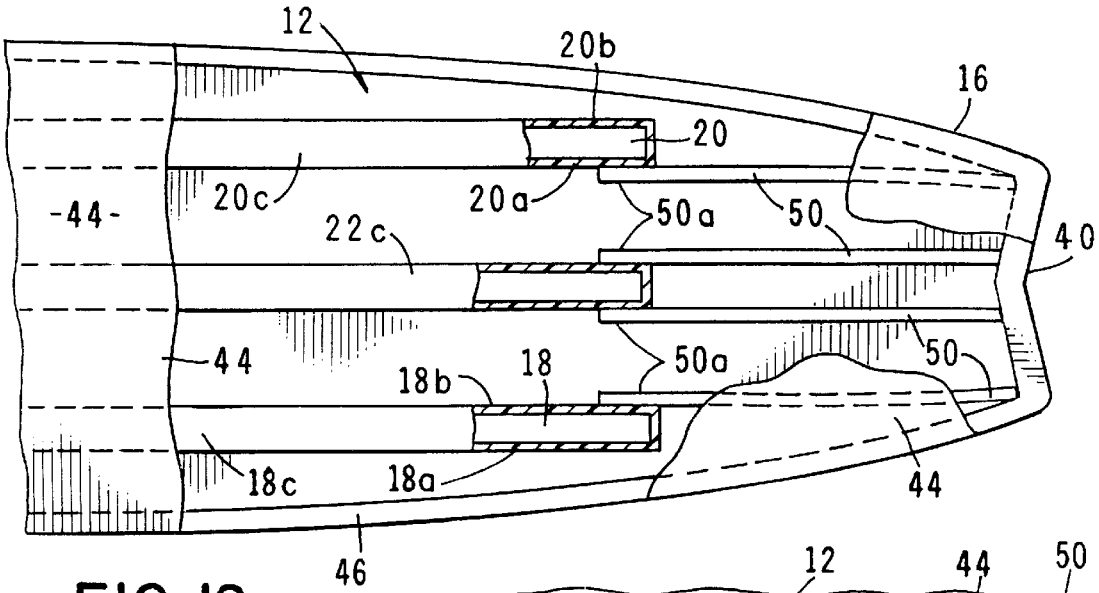
FIG. 12 is a fragmentary bottom plan view of the rear portion of the surfboard partly broken away to show internal construction.
Figure 14:
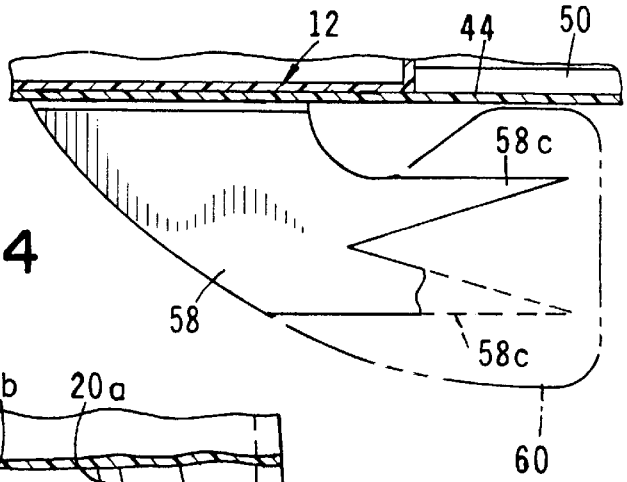
FIG. 14 is an enlarged, fragmentary, cross-sectional view similar to FIG. 8, but showing the opposite side of the fin of the surfboard.

Provided between structural reinforcement core 14 and bottom panel 44 are a plurality of longitudinally extending, transversely spaced-apart reinforcing spars 50. As best seen in FIG. 5, the forward end 50*a* of each of the spars 50 is interconnected to a selected one of the side walls of the transversely spaced-apart channels 18, 20, and 22 (see also FIGS. 6 and 7). Additionally, the bottom surface of each of the spars 50 rests upon and is preferably bonded to the upper surface of lower panel 44 (FIG. 7).

Figures 1, 2:
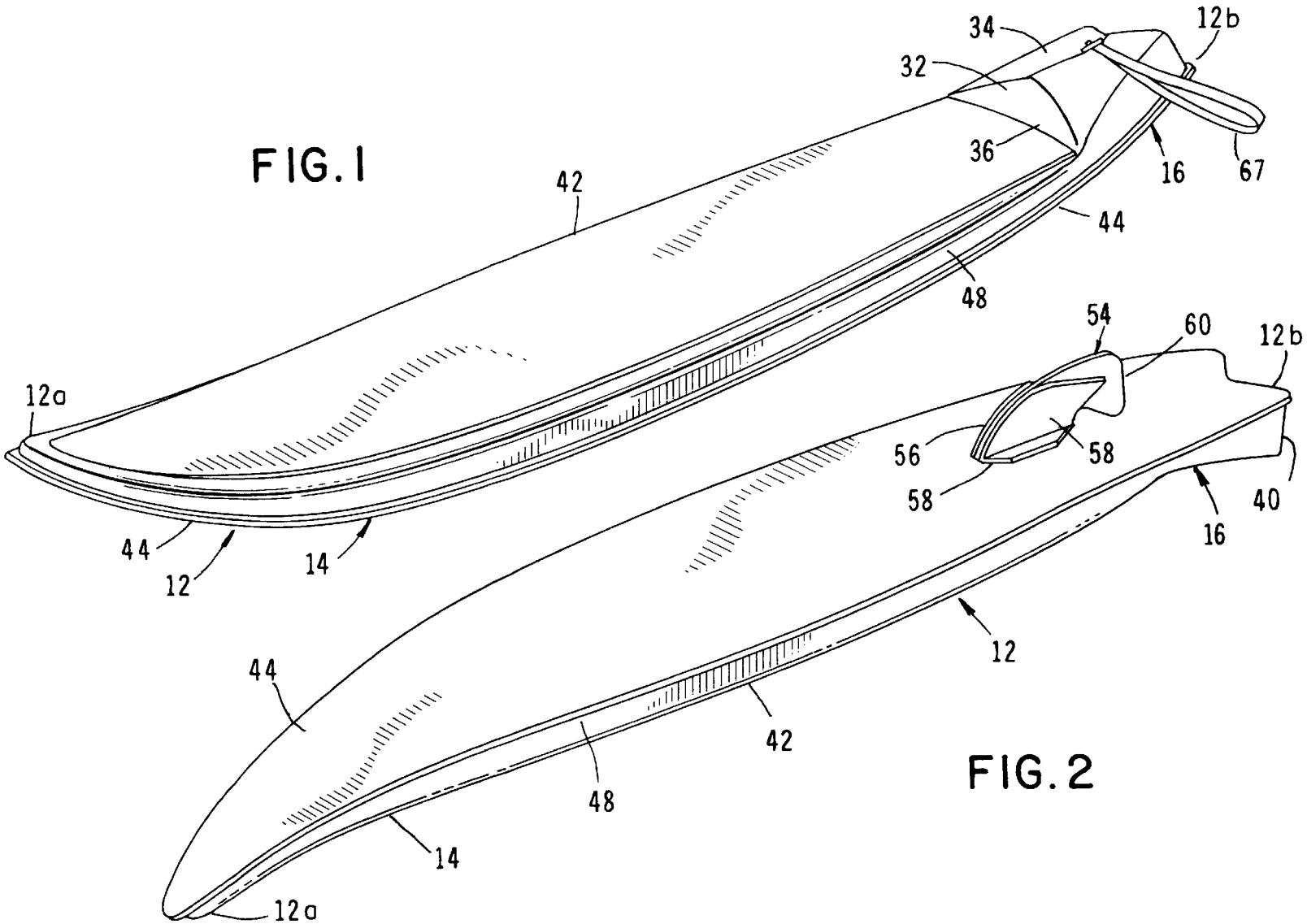
FIG. 1 is a generally perspective top view of one form of the lightweight surfboard of the present invention.
FIG. 2 is a generally perspective bottom view of the surfboard shown in FIG. 1.
Figure 9:
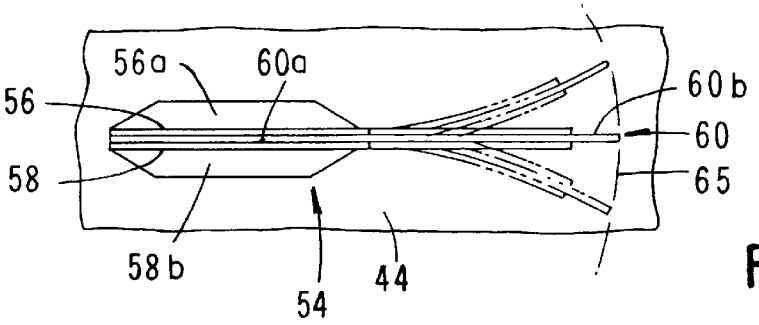
FIG. 9 is a view taken along lines 9—9 of FIG. 8.
Figure 8:
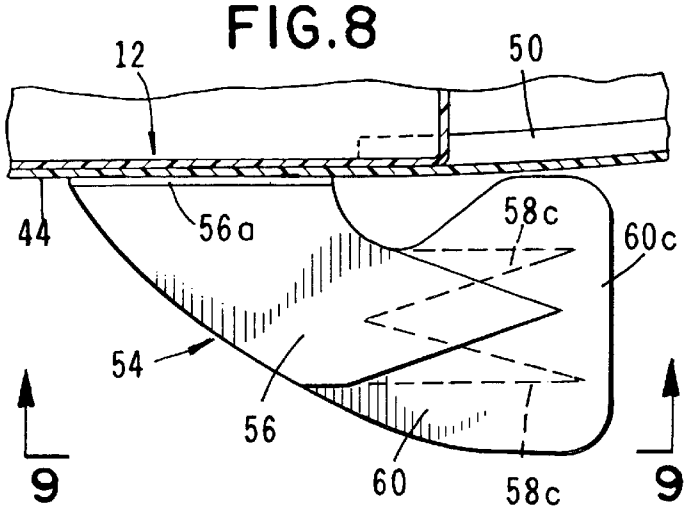
FIG. 8 is an enlarged, cross-sectional view taken along lines 8—8 of FIG. 6.

An important feature of the surfboard construction of the present invention comprises a rudder assembly 54 (FIG. 3) which is interconnected to lower panel 44 of the surfboard in the manner best seen in FIGS. 2 and 6. Rudder panel 54 here comprises first and second transversely spaced-apart support walls 56 and 58, each of which terminates in an upper, generally perpendicularly extending flange portion 56*a* and 58*a* respectively. Flanges 56*a* and 58*a* are suitably interconnected with the lower surface of panel 44 by adhesive bonding or the like and are spaced apart a distance so as to closely receive a flexible rudder panel 60, the body portion 60*a* of which is disposed between port walls 56 and 58. As indicated in FIG. 8, the rearward extremity of support wall 56 is generally angularly shaped while the rearward portion of support wall 58 includes a pair of spaced-apart, angularly shaped leg-like portions 58*c*. This novel construction provides greater support: to rudder panel 60 and prevents breakage of the panel during use. Turning particularly to FIG. 9, it is to be noted that support walls 56 and 58 as well as rudder panel 60 are preferably constructed of a yieldable, deformable plastic material so that the rudder can deform along an angular path generally designated in FIG. 9 by the numeral 65. This important feature of the apparatus of the invention permits rudder 60 to be used to smoothly turn the surfboard as the rudder panel swings through the arcuate path shown in FIG. 9. Due to the flexible characteristics of the material from which the rudder panel and support walls are formed, the rudder exhibits a tendency to return to the axially aligned position shown by the solid line in FIG. 9 wherein the rearward portion 60*b* of the rudder panel tends to continuously return the surfboard to a straight line path of travel.

As best seen in FIGS. 3 and 5, a securement strap 67 is appropriately affixed to rear section 16 of the structural reinforcement core and is constructed so that it can be conveniently grasped by the surfer during surfing exercises. Strap 67 can be constructed from a suitable strapping material such as canvas.

While various materials such as high-impact styrene and high-density polyethylene can be used to fabricate the surfboard of the present invention, a polymer produced by combining three monomers namely acrylonitrile, butadiene and styrene (ABS) is preferred. ABS is generally preferred because it is inexpensive, durable and can be processed by most of the commonly used techniques for thermoplastics. For example, ABS can be injection molded, compression molded and easily formed by well known thermo-vacuum forming techniques. Thermo-vacuum forming is generally preferred in carrying out the method of the present invention. More particularly, the method of the invention comprises the steps of first controllably heating a thin, elongated, generally planar first sheet of ABS to an elevated temperature of between about 300 degrees Fahrenheit and 600 degrees Fahrenheit to form a heated panel. This done the heated panel is thermo-vacuum formed into the structural core of the character previously described herein. More particularly, the heated panel is carefully formed to provide a structural core having a marginal flange portion and a plurality of channels each channel extending longitudinally of the core and including side walls interconnected by a base wall. Once the structural reinforcement core is thus formed, a second thin ABS plastic sheet or panel is overlayed over the plurality of channels and bonded to the strategically formed structural core. As previously mentioned, the second plastic sheet is preferably bonded to each of the support surfaces 24, 26, 28, and 30 formed on the structural reinforcement core. This done, a third thin sheet or panel of ABS plastic is emplaced over the bottom of the structural core so that: the panel overlays flange portions 46 as well as the bottom walls 18*c*, 20*c*, and 22*c* of the longitudinally extending channels formed in the structural support core. Bonding of the second and third ABS sheets can be accomplished by any number of means well known to those skilled in the art such as adhesive bonding, sonic weldment, and like techniques. A suitable adhesive for use in the bonding process comprises a solvent cement sold by IPS Corporation, of Gardena, California.

After the basic structure of the surfboard is thus constructed, a pair of support walls of the character shown in the drawings and identified by the numerals 56 and 58 are formed from a sheet of ABS plastic. The flange portions of the support walls are then bonded to the third plastic sheet in a spaced-apart relationship and a yieldably deformable rudder panel 60 is formed from the ABS sheet and bonded intermediate support walls 56 and 58 in the manner shown in the drawings to complete the rudder panel assembly. As best seen by referring to FIG. 3, during the thermo-vacuum forming step, both the forward and rearward extremities 12*a* and 12*b* of the reinforcement core are upturned to form a generally conventional surfboard configuration.

While the various dimensions of the surfboard construction vary according to intended end use, the structural reinforcement core 12 is preferably formed from a sheet of ABS having a thickness of on the order of 0.125 inches. Similarly, top sheet 42 preferably has a thickness of about 0.040 while bottom sheet 44 has a thickness of about 0.060. Support: surfaces 24, 26, and 28 are preferably on the order of about 3 to 3½ inches in width so as to provide added strength and an adequate adhesive bonding surface. The width of channels 18, 20, and 22 can vary depending upon the overall width of the surfboard, but preferably are on the order of about 1½ inches wide. For best performance, the maximum thickness of the forward section 14 of the surfboard is on the order of two inches. With respect to the rudder assembly 54, the support walls 56 and 58 are preferably formed from an ABS sheet having a thickness of on the order of 0.090 inches, while the rudder panel 60 is preferably formed from a sheet of ABS plastic having a thickness of on the order of ⅛th inch. With this construction the rudder panel will have sufficient flexibility to enable smooth turning of the surfboard and will tend to accelerate the board out of the turns as the rudder panel tends to return to its axially aligned configuration.

In summary, it should be understood that the dimensions set forth in the foregoing paragraphs are for illustration purposes only and in no way restrict the actual configuration of surfboards made in accordance with the methods of the present invention.

Figure 15:
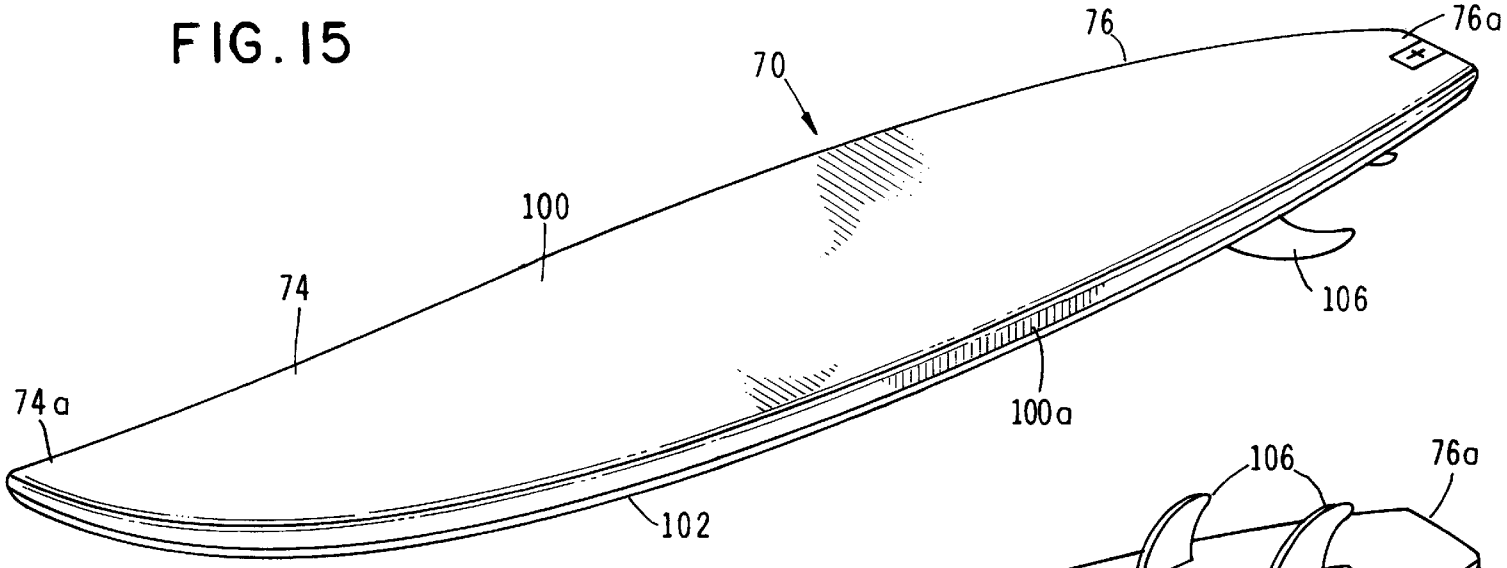
FIG. 15 is a generally perspective top view of an alternate form of the lightweight surfboard of the present invention.
Figure 16:
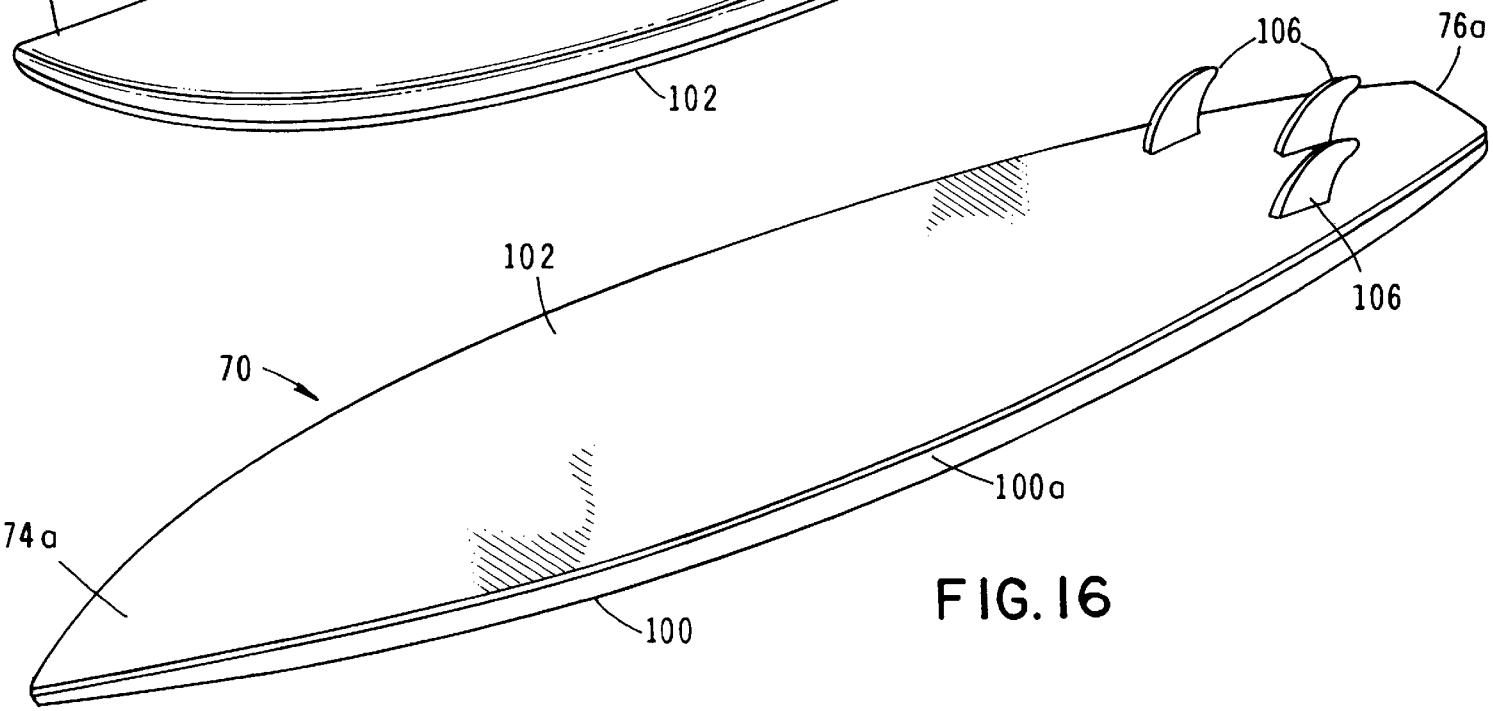
FIG. 16 is a generally perspective bottom view of the surfboard shown in FIG. 1.
Figure 17:
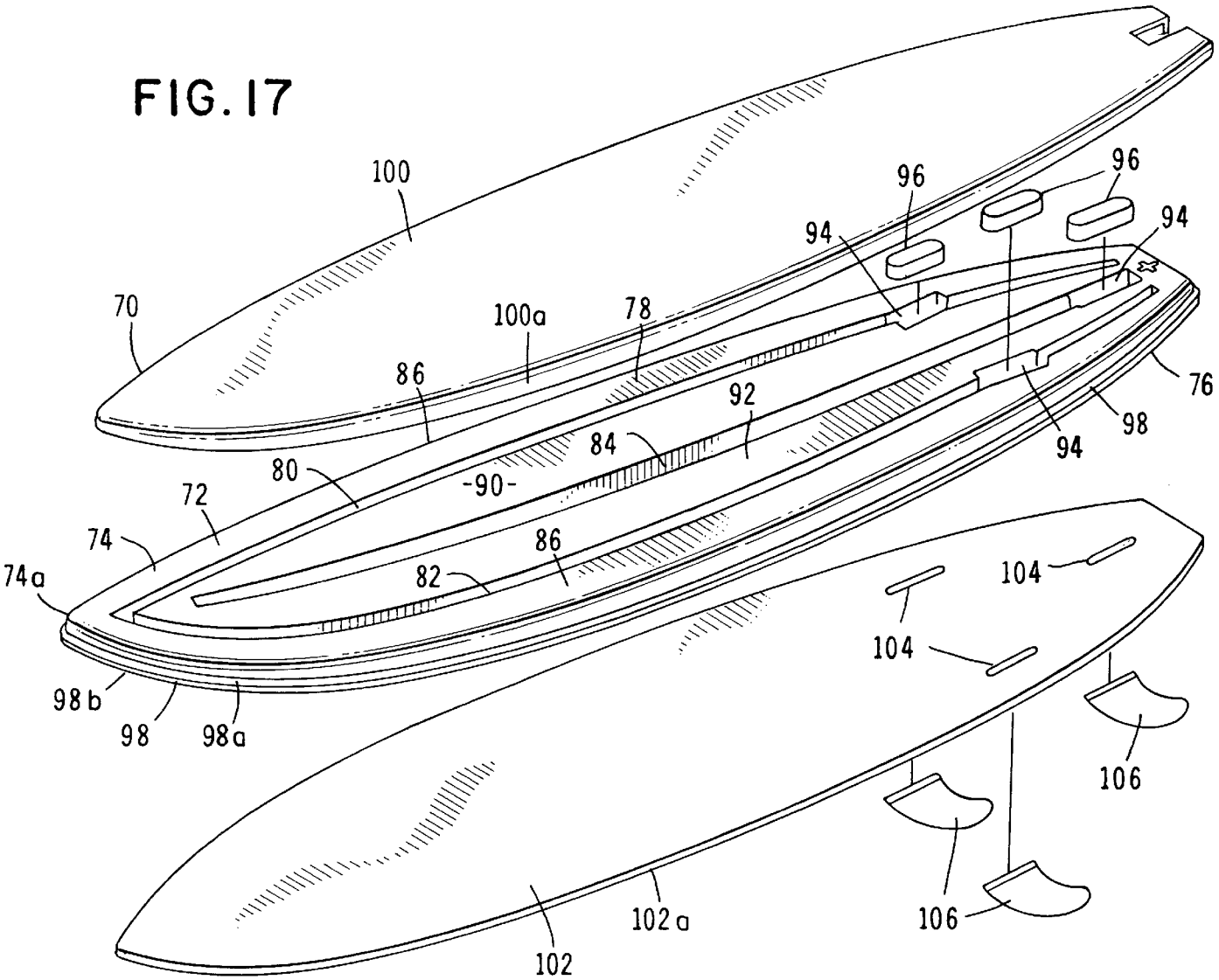
FIG. 17 is a generally perspective, exploded view of the surfboard shown in FIGS. 1 and 2.
Figure 22:
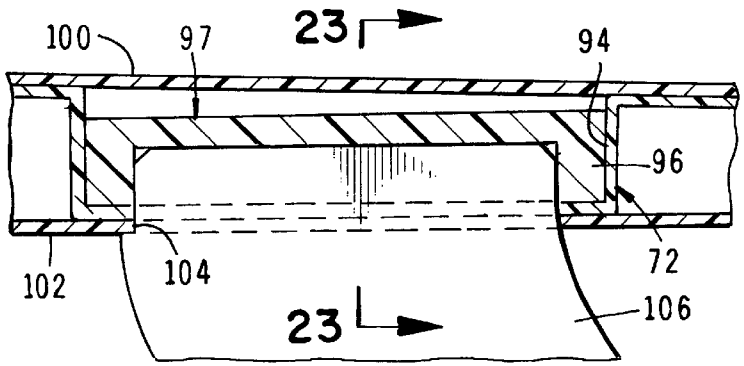
FIG. 22 is a greatly enlarged, cross-sectional view taken along lines 22—22 of FIG. 21.
Figure 20:
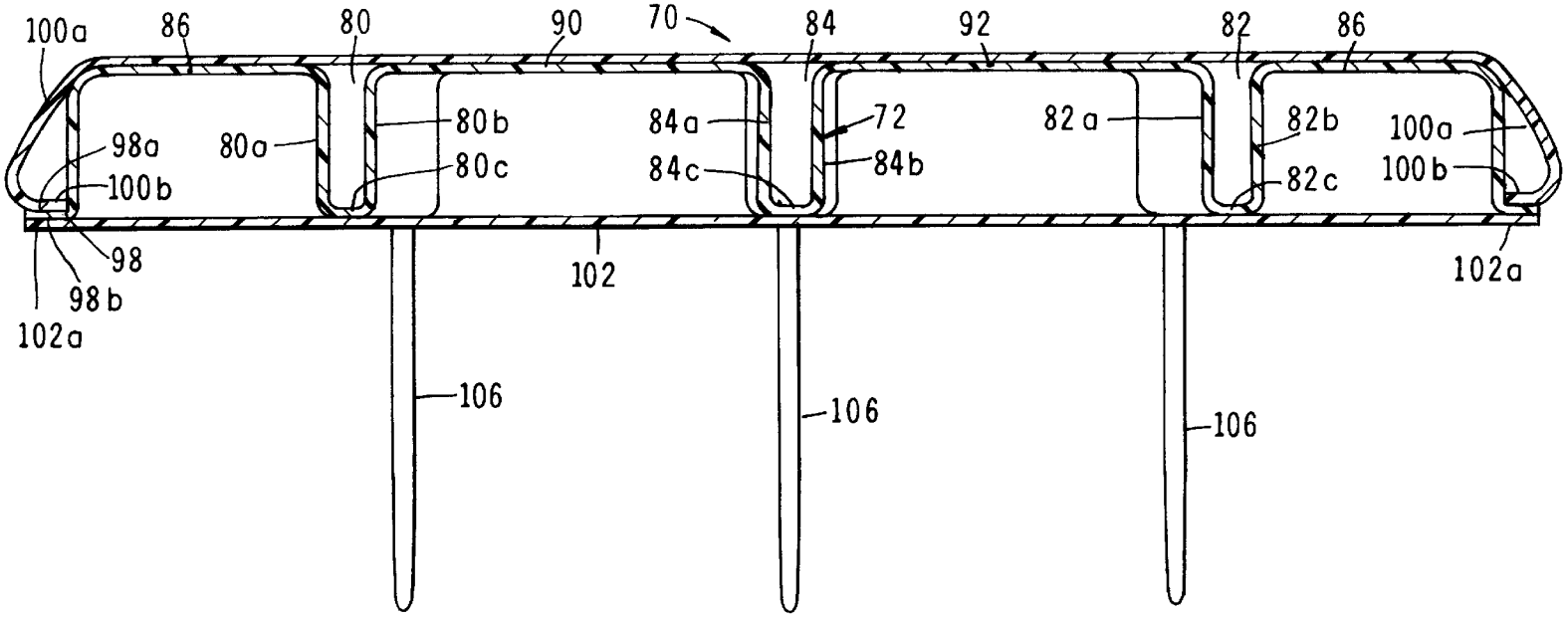
FIG. 20 is a greatly enlarged, cross-sectional view taken along lines 20—20 of FIG. 18.

Referring now to FIGS. 15 through 17, an alternate form of the flotation device of the present invention is there illustrated. This device, shown here as a surfboard 70, comprises a structural reinforcing core 72 of a slightly different construction from that shown in FIG. 1 through 14. As before, core 72 of this form of the flotation device includes a forward section 74, a rearward section.76, and a central section 78, and is provided with first and second longitudinally extending channels 80 and 82 (FIGS. 17 and 20) which are defined by transversely spaced-apart side walls 80*a* and 80*b* and 82*a* and 82*b* respectively. As best seen in FIG. 20, the side walls of the channels are interconnected by integrally formed base walls 80*c* and 82*c* respectively which comprise first lower surfaces. Also formed in the structural reinforcing core is a center channel 84 which has side walls 84*a* and 84*b* interconnected by a base wall 84*c* defining a lower surface (FIG. 20). In addition to channels 80, 82 and 84, reinforcing core 72 also includes upper support surfaces 86 which are disposed outboard of channels 80 and 82 (first surfaces). Disposed between side channel 80 and center channel 84 is a support surface 90 and, disposed between side channel 82 and center channel 84 is a support surface 92 (second surfaces). As best seen in FIG. 17, each of the channels includes proximate its rearward extremity a fin block receiving cavity 94 which fixedly receives the fin block 96 of a fin assembly 97 of the invention which is of conventional construction. (See also FIGS. 17 and 22).

Figure 23:
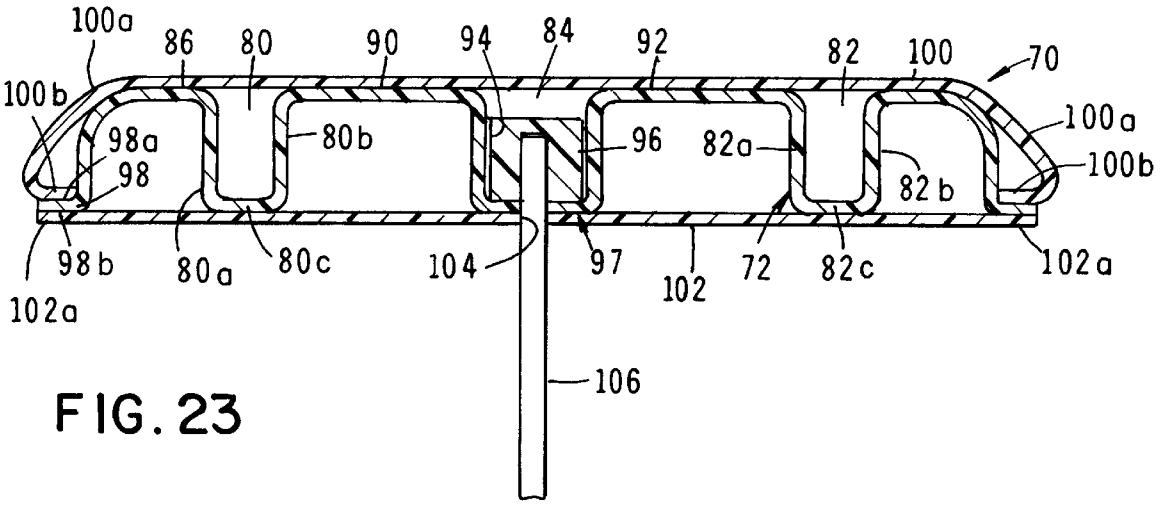
FIG. 23 is a cross-sectional view taken along lines 23—23 of FIG. 22.

It is to be noted that in this latest form of the flotation device of the invention, channels 80, 82, and 84 are somewhat more narrow than the channels of the earlier embodiment as shown in FIG. 6. More particularly, the channels in this latest embodiment of the invention are only about ⅛th the width of each of the support surfaces 90 and 92. It is also to be observed that, for purposes presently to be discussed, core 72 is provided with a peripheral flange 98 which circumscribes sections 74, 76 and 78. Flange 98 includes upper and lower surfaces 98*a* and 98*b* respectively (FIGS. 17, 20, and 23).

Figure 18:
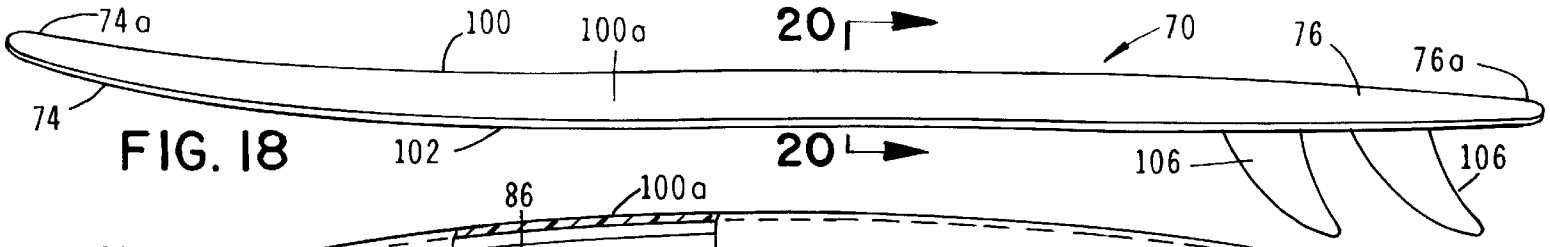
FIG. 18 is a side-elevational view of the surfboard shown in FIGS. 1 and 2.
Figure 19:
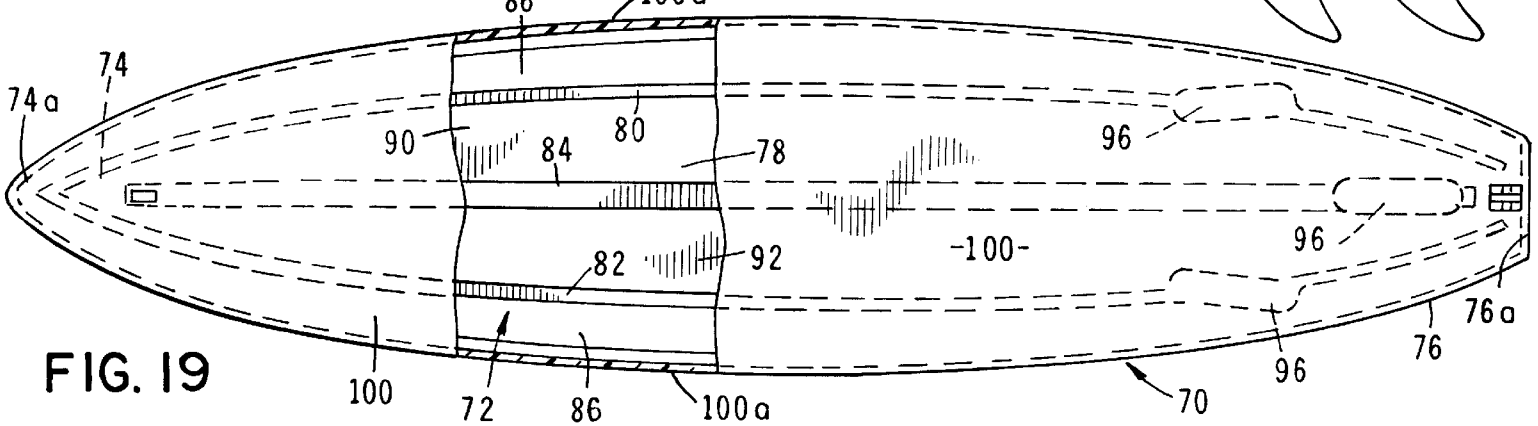
FIG. 19 is a top plan view of the surfboard of FIG. 1 partly broken away to shown internal construction.
Figure 21:
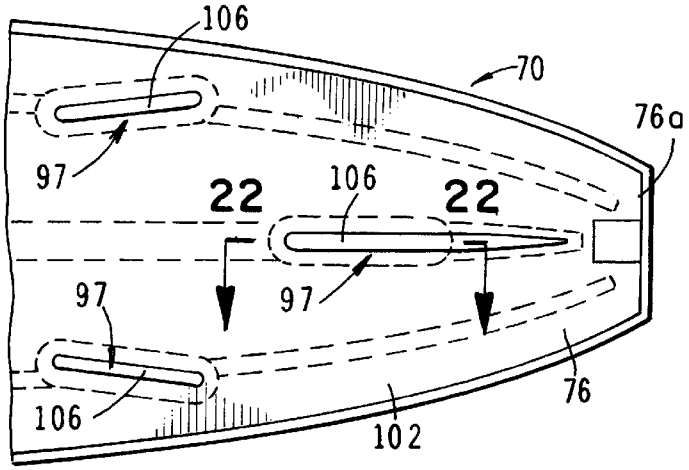
FIG. 21 is a fragmentary bottom view of the surfboard shown in FIG. 19.

As best seen in FIGS. 18 and 19, forward section 74 of structural reinforcement core 72 is upturned and terminates in a forward bow portion 74*a*. Similarly, as indicated in FIGS. 19 and 21, rear section 7,6 terminates in a generally squared-off stern portion 76*a*.

overlaying structural reinforcement core 72 is a first, or upper panel 100. As indicated in FIG. 20, panel 100 engages support surfaces 86, 90, and 92 and is preferably bonded thereto by sonic bonding or by a suitable adhesive the character of which may vary depending upon the type of plastic material being used to construct the surfboard. An important feature of panel 100 is the provision of a downwardly curved, peripheral portion 100*a* which is generally "C" shaped in cross section. As best seen in FIGS. 20 and 23, portion 100*a* terminates in an inturned flange 100*b* which is bonded to upper surface 98*a* of core flange 98. In similar fashion, a second or lower panel 102 overlays the bottom of the structural reinforcement core and, as shown in FIGS. 20 and 23 engages base walls 80*c*, 82*c*, and 84*c* of channels 80, 82, and 84. As indicated in FIGS. 20 and 23, the peripheral edge portion 102*a* of panel 102 is bonded to lower surface 98*b* of core flange 98. With this novel construction, the sides of the flotation device are smoothly rounded so as to provide a sleek, attractive appearance. Being smoothly curved, the side of the flotation device also, importantly, prevents injury to swimmers. Curved peripheral portion 100*a* circumscribes the forward and central portions of the flotation device and is interconnected at its rearward extremity with stern portion 76*a* (FIGS. 19 and 21). As before, upper and lower panels 100 and 102 are affixed to reinforcing core 72 by any suitable manner such as adhesive bonding.

As best seen in FIG. 17, bottom panel 102 is provided with a plurality of longitudinally extending, transversely spaced-apart fin receiving openings 104 which index with the previously identified block-receiving cavities 94 formed in reinforcing core 72. Receivable within openings 104 for interconnection with fin blocks 96 are a plurality of fins 106 of conventional configuration. (See also FIGS. 22 and 23). Blocks 96 and fins 106, which together comprise the fin assemblies 97 of the invention, are of a character well known in the art and are commercially available from sources such as the Chinook Company of Hood River, Oreg.

Figure 26:
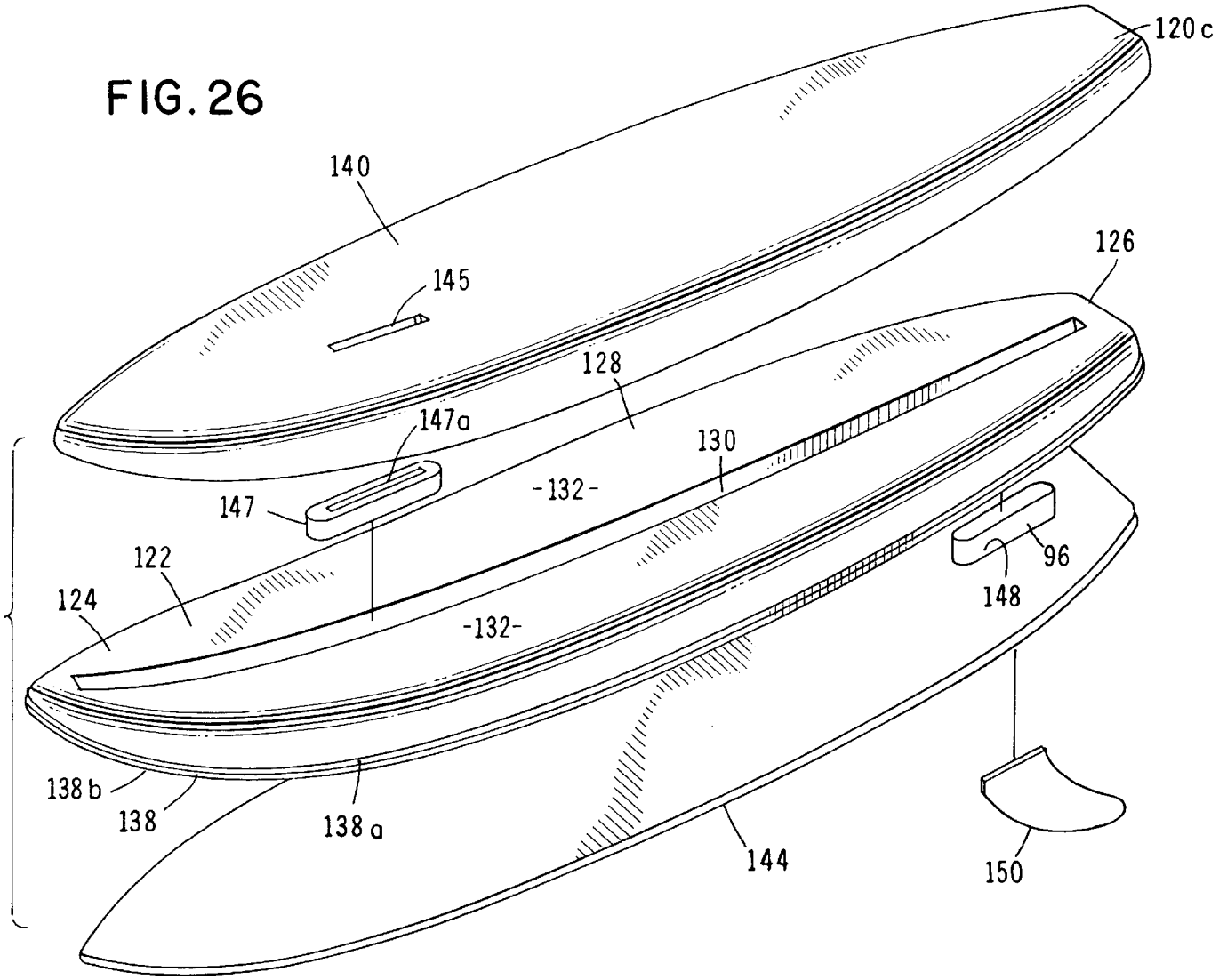
FIG. 26 is a generally perspective, exploded view of the sailboard construction shown in FIGS. 24 and 25.
Figure 27:
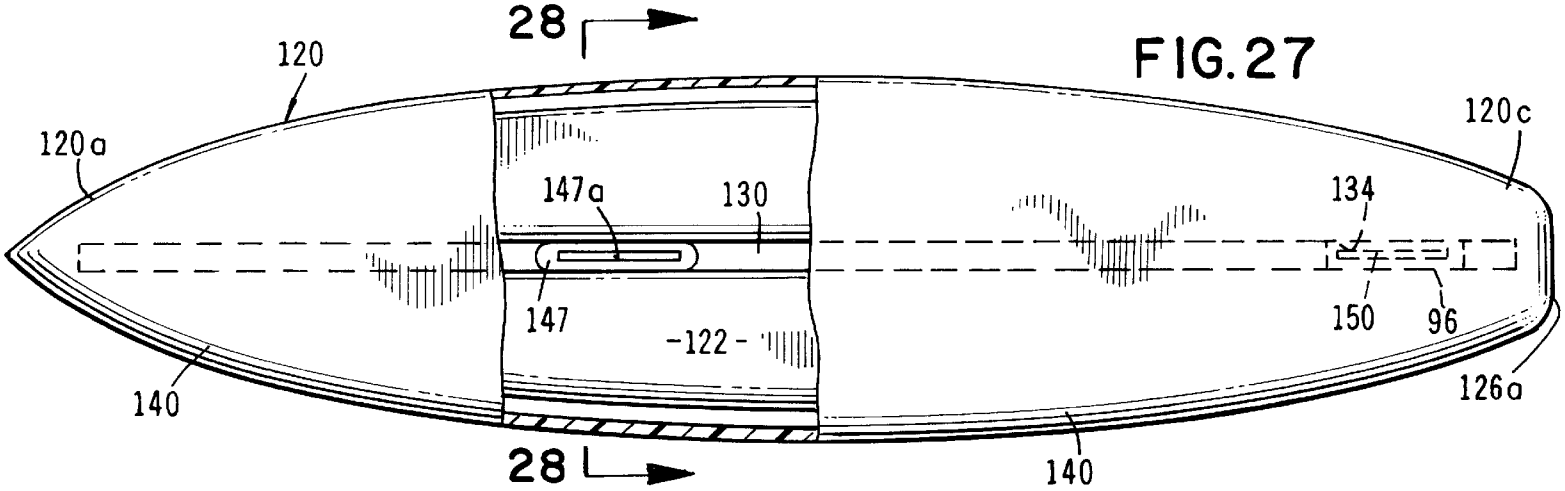
FIG. 27 is a top plan view of the sailboard construction of FIG. 24 partly broken away to show internal construction.
Figure 28:
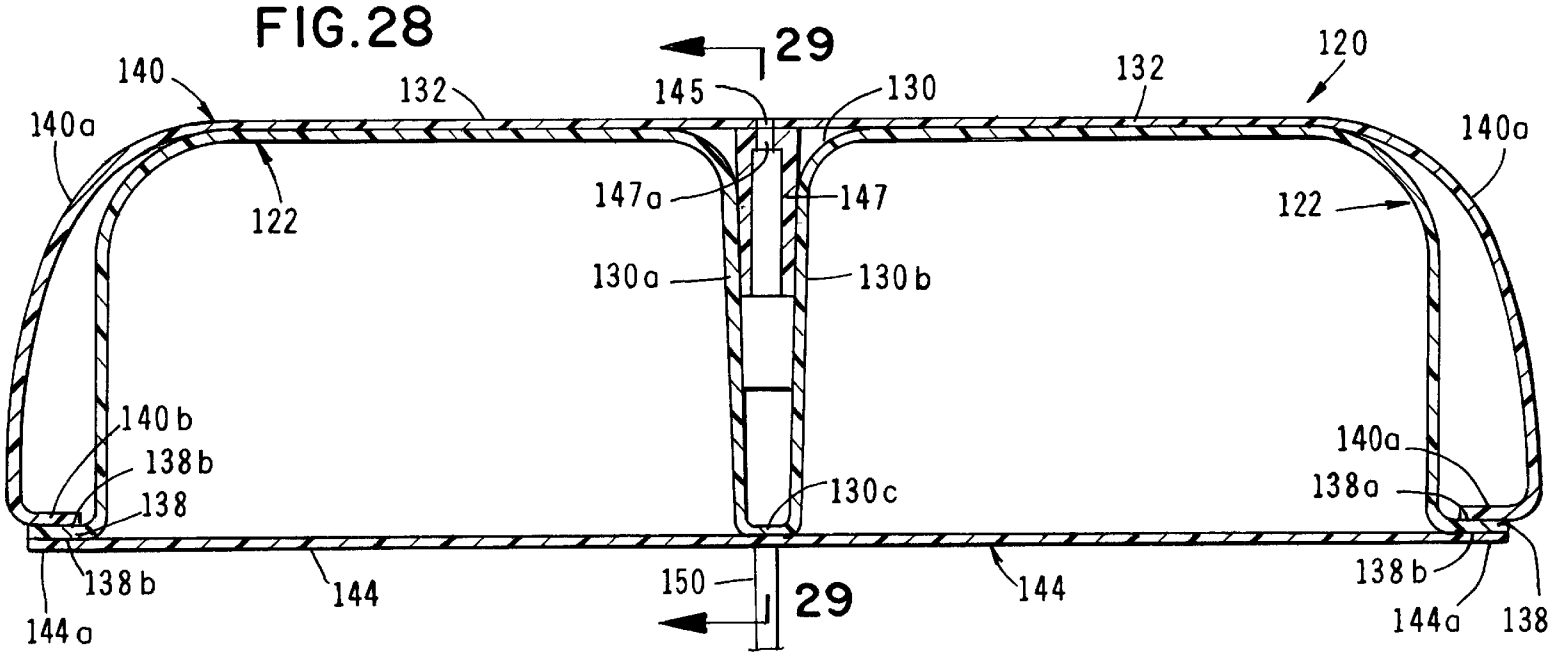
FIG. 28 is a cross-sectional view taken along lines 28—28 of FIG. 27.

Turning next to FIGS. 24 through 30 still another form of flotation device of the present invention is there illustrated. This device, shown here as a sailboard 120, comprises a structural reinforcing core 122 (FIG. 26) which is somewhat thicker and is of a slightly different construction from that shown in FIGS. 15 through 23. As before, core 122 of this form of the flotation device includes a forward section 124, a rearward section 126, and a central section 128. Reinforcing core 122 is provided with a first longitudinally extending channel 130 (FIGS. 26 and 28) which is defined by transversely spaced-apart side walls 130*a* and 130*b*. As best seen in FIG. 28, the side walls of the channel are interconnected by an integrally formed base wall 130*c* which comprise a first lower surface. In additional to channel 130, reinforcing core 122 also includes first upper support surfaces 132 disposed outboard of channel 130 . As best seen in FIG. 27, channel 130 terminates proximate its rearward extremity in a fin block-receiving cavity, 134 which receives a fin block 96 of conventional construction.

It is to be noted that in this latest form of the flotation device of the invention, the channel 130 is quite narrow being on the order of ½ inch in width. It is also to be observed that as before, core 122 includes a peripheral flange 138 which circumscribes portions 124, 126, and 128 and includes upper and lower surfaces 138*a* and 138*b* respectively (FIGS. 26 and 28).

Figure 24:
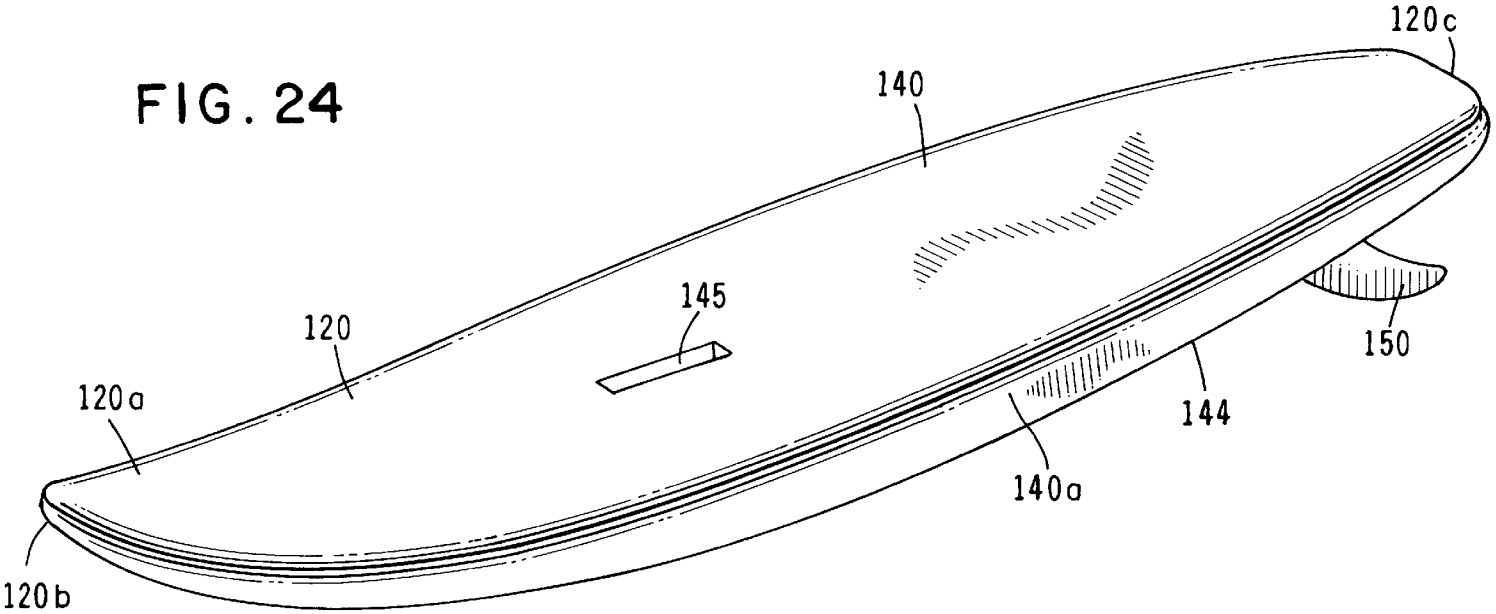
FIG. 24 is a generally perspective top view of a sailboard construction of the present invention.
Figure 25:
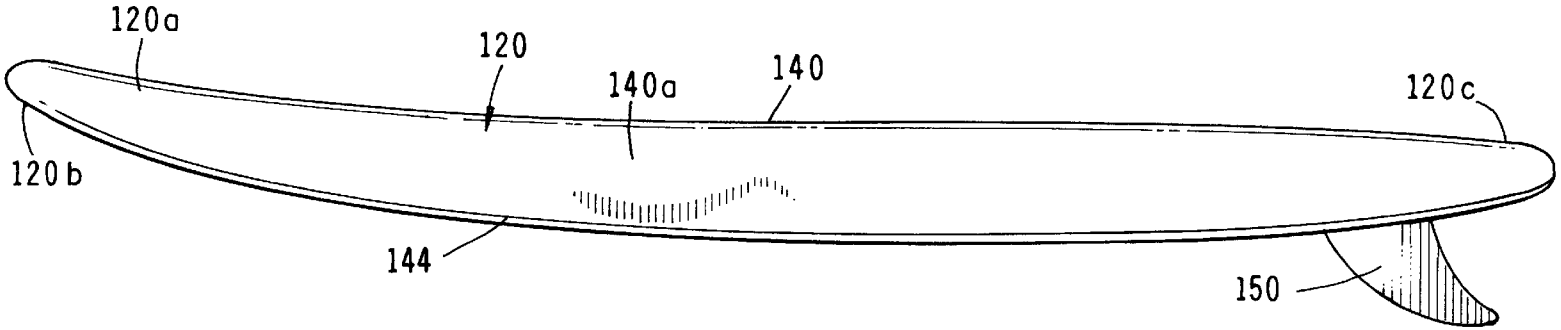
FIG. 25 is a side view of the sailboard construction of FIG. 24.

As best seen in FIG. 24, the forward section 120*a* of the sailboard is upturned and terminates in a forward bow portion 120*b*. Similarly, as indicated in FIGS. 24 and 27, rear section 120*c* terminates in a generally squared-off stern portion 126*a*.

Overlaying the structural reinforcement core is a first, or upper panel 140. As shown in FIG. 28, panel 140 engages support surfaces 132 and is preferably bonded thereto by sonic bonding or by a suitable adhesive, the character of which may vary depending upon the type of plastic material being used to construct the surfboard. An important feature of upper panel 140 is the downwardly curved, peripheral portion 140*a* which is generally "C" shaped in cross section. As best seen in FIGS. 26 and 28, portion 140*a* terminates in an inturned flange 140*b* which is bonded to upper surface 138*a* of core flange 138. In similar fashion, a second or lower panel 144 overlays the bottom of the structural reinforcement core and, as shown in FIG. 28, engages and is bonded to base wall 130*c* of channel 130. Further, as shown in FIG. 28, the peripheral edge portion 144*a* of panel 144 is bonded to lower surface 138*b* of core flange 138. With this novel construction the sides of the sailboard are smoothly rounded so as to prevent injury to the swimmers. As was the case with the surfboard construction, peripheral portion 140*a* circumscribes the forward and central portions of the sailboard and is interconnected at its rearward extremities with stern portion 126 (FIGS. 26 and 27). As before upper and lower panels 142 and 144 are affixed to reinforcing core 122 by any suitable manner such as adhesive bonding.

Figure 29:
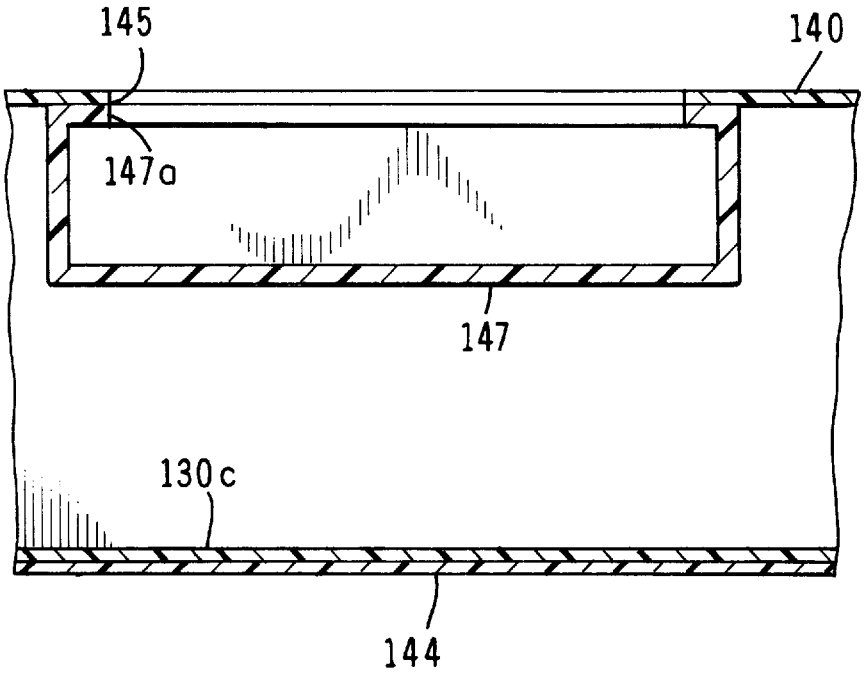
FIG. 29 is an enlarged, cross-sectional view taken along lines 29—29 of FIG. 28.
Figure 30:
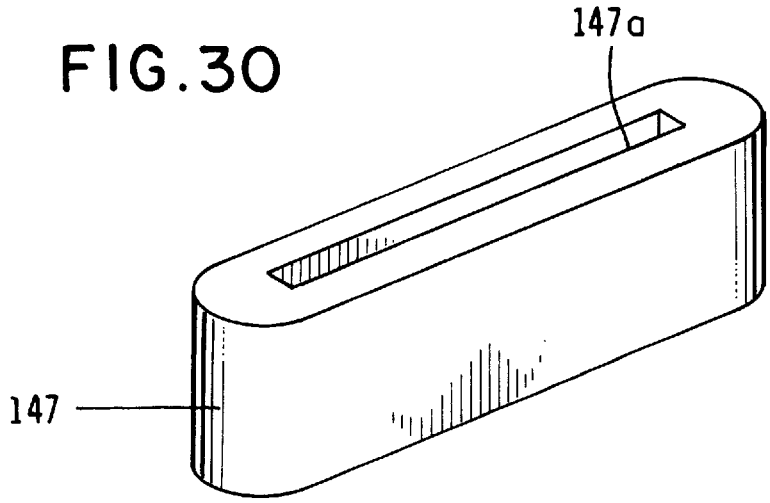
FIG. 30 is a generally perspective view of the sail block of the sailboard construction shown in FIG. 24.
Figure 31:
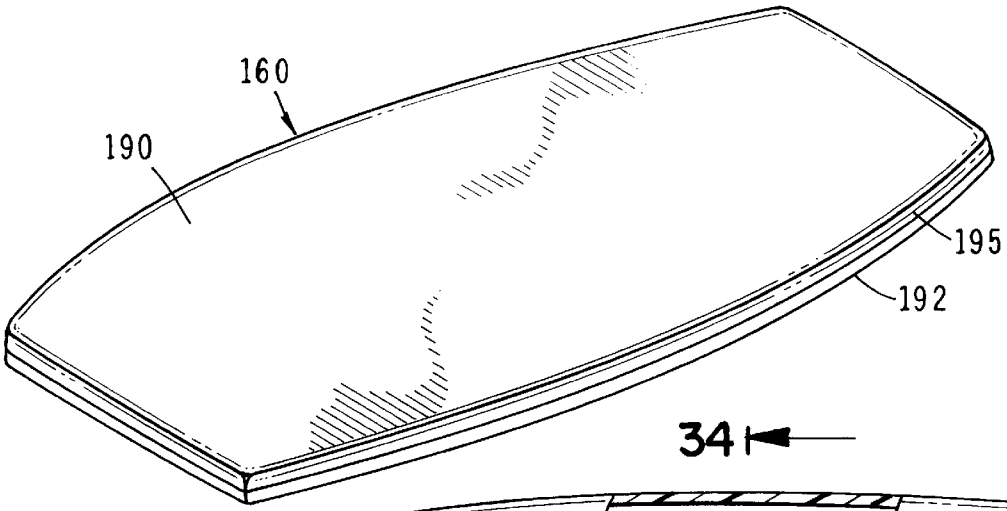
FIG. 31 is a generally perspective top view of a body board construction of the present invention.
Figure 32:
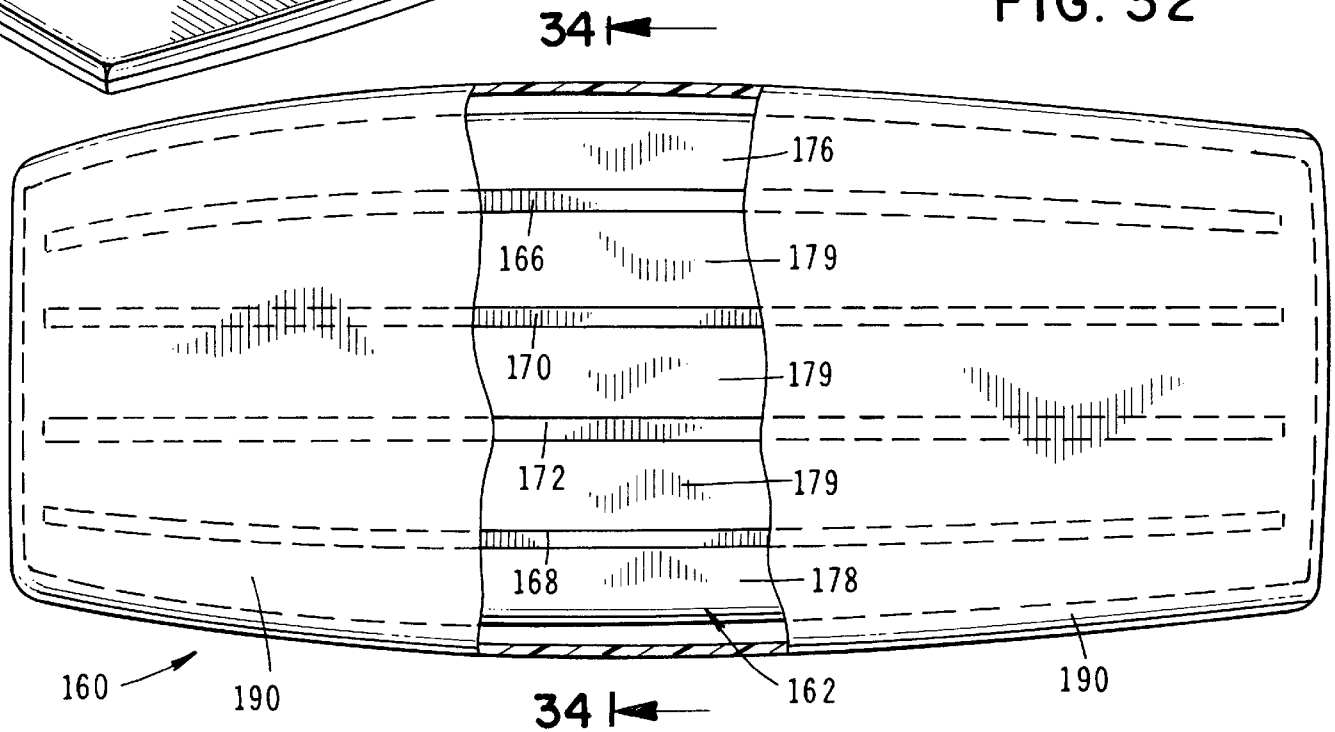
FIG. 32 is a top plan view of the body board construction of FIG. 31 partly broken away to show internal construction.
Figure 33:
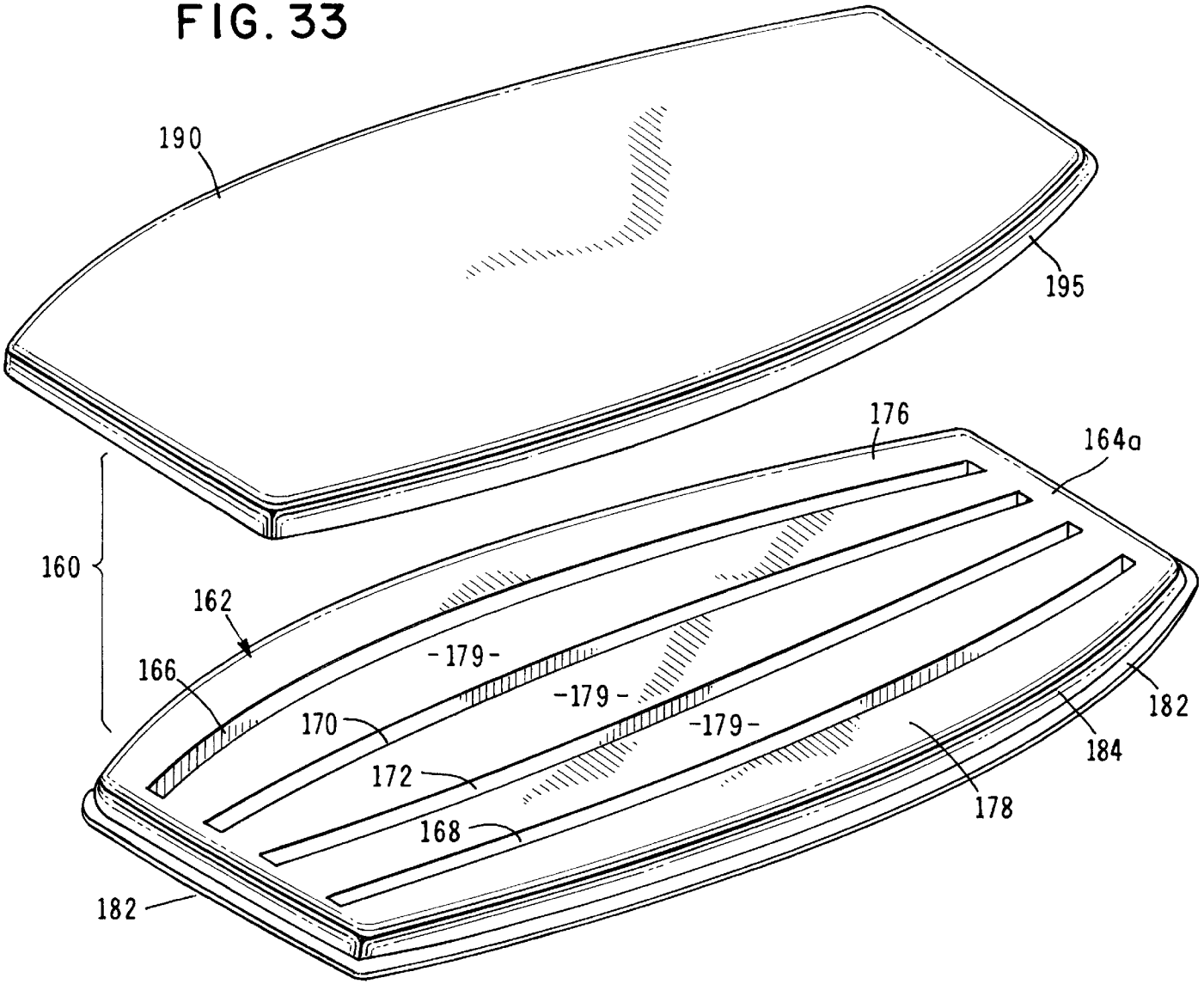
FIG. 33 is a generally perspective, exploded view of the body board construction.

As shown in FIG. 26, upper panel 140 is provided with a longitudinally extending slot 145 which indexes with channel 130 and also is a sail block 147, which is of conventional construction, and which is receivable within and bonded to the walls of channel 130 (see also FIGS. 28, 29, and 30). In a manner well known to those skilled in the art, a conventional sailboard sail assembly can be interconnected with sail block 147. Sail block 147 which is similarly available from the Chinook Company is provided with a central slot 147*a* within which the connector portion of the mast of the sailboard (not shown) is slidably received.

As also illustrated in FIG. 26, bottom panel 144 is provided with a longitudinally extending, fin assembly receiving opening 148 which indexes with channel 130. Receivable within opening 148, for interconnection with a fin block 149, which is also commercially available from the Chinook Company, is a fin 150 of conventional configuration.

Figure 34:
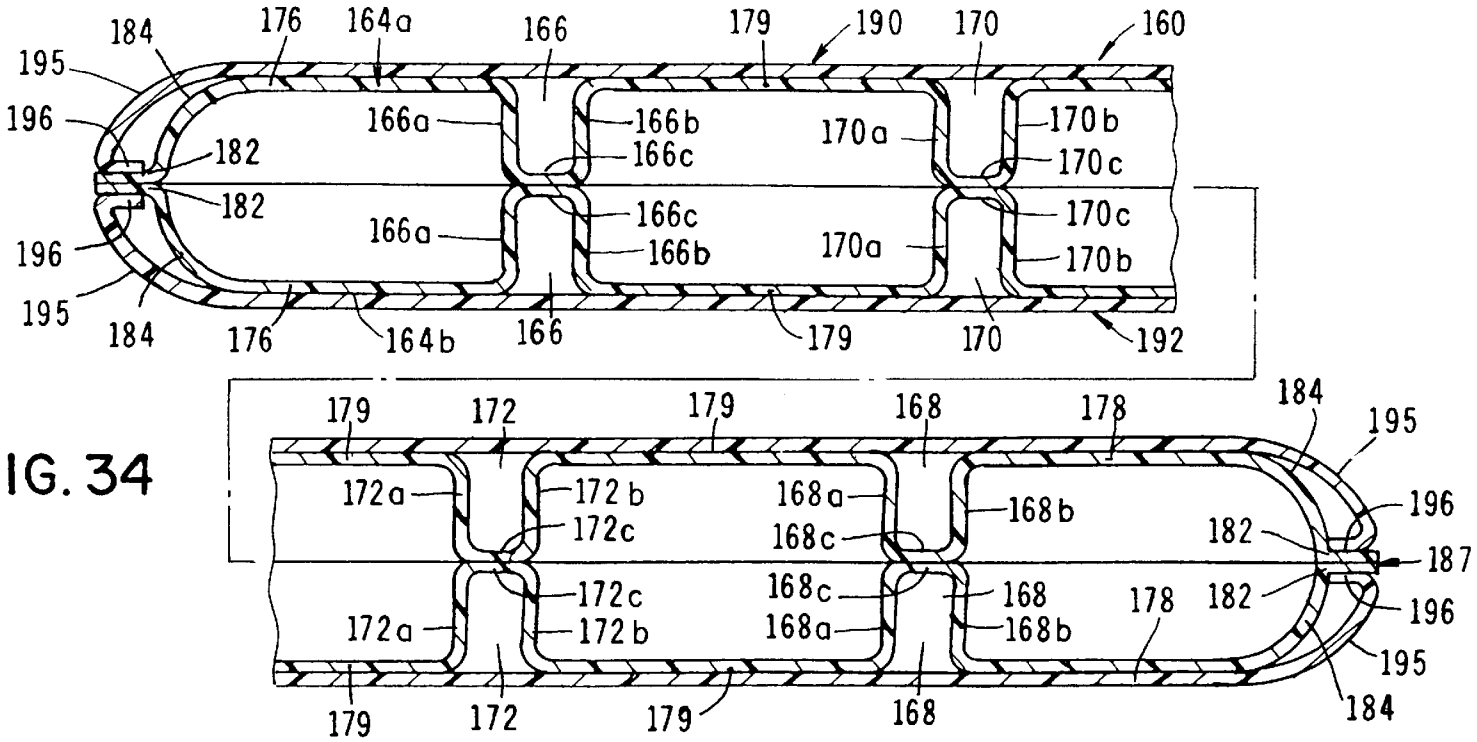
FIG. 34 is a greatly enlarged, cross-sectional view taken along lines 34—34 of FIG. 32.

Referring next to FIGS. 31 through 34, yet another form of flotation device of the present invention is there illustrated. This device, shown here as a body board 160, comprises a structural reinforcing core assembly 162 which is uniquely made up of back-to-back reinforcing cores 164*a* and 164*b* (FIG. 34). Each of the reinforcing cores 164*a* and 164*b* is of similar construction to previously described reinforcing cores 72 and 122 and each is provided with marginally disposed first and second longitudinally extending channels 166 and 168 (FIGS. 33 and 34) which are defined by transversely spaced-apart side walls 166*a* and 166*b* and 168*a* and 168*b* respectively. The side walls of the channels are interconnected by integrally formed base walls 166*c* and 168*c* respectively which comprise first lower surfaces (FIG. 34). Also formed in the structural reinforcing core is a pair of centrally disposed channels 170 and 172 each having side walls 170*a* and 170*b* and 172*a* and 172*b* respectively which are interconnected by lower surface defining base walls 170*c* and 172*c* respectively. In addition to channels 166, 168, 170 and 172, each reinforcing core 164*a* and 164*b* also includes a support surface 176 disposed outboard of channel 166 and a support surface 178 disposed outboard of channel 168 (first surfaces). Disposed inwardly of channels 166 and 168 are three adjacent support surfaces 179 (first surfaces). After the structural cores 164*a* and 164*b* are formed, the flanges 182 which circumscribe the downwardly curved margins 184 of each of the cores are placed in engagement in the manner shown in FIG. 34 and are adhesively bonded together for the core assembly 187. In the manner presently to be described, the specially configured top and bottom panels 190 and 192 respectively are emplaced over the core assembly.

While various materials such as those previously discussed, including high-impact styrene and high-density polyethylene can be used to fabricate the structural cores of the flotation devices of this latest form of the invention, a polymer produced by combining three monomers namely acrylonitrile, butadiene and styrene (ABS) is preferred. Such materials can be injection molded, compression molded and easily formed by well known thermo-vacuum forming techniques. Thermo-vacuum forming is generally preferred in carrying out the method of the present invention.

The method of the invention for constructing the structural cores of the flotation devices of FIGS. 15 through 29 is similar to that previously described herein and comprises the steps of first controllably heating a thin, elongated, generally planar first sheet of material to an elevated temperature of between about 300 degrees Fahrenheit and 600 degrees Fahrenheit to form a first heated panel. This done the heated panel is thermo-vacuum formed into the structural core of the particular flotation device illustrated and described herein. More particularly, the heated panel is carefully formed to provide a structural core having a central portion, a peripheral flange surrounding the central portion and at least one channel extending longitudinally of the core and defining spaced-apart side walls interconnected by a base wall.

Once the structural reinforcement cores of the flotation device of FIGS. 15 through 29 is formed, a second thin ABS plastic sheet or panel is heated to form a second or upper shaped panel having a central portion surrounded by a curved marginal portion terminating in an inturned connecting flange. After forming the second shaped panel, it is emplaced over the shaped structural core. The inturned connecting flange is then bonded to the peripheral flange of the reinforcing core and the central portions of the second shaped panel are bonded to each of the support surfaces of the structural core. This done, a third thin sheet or panel of material is emplaced over the bottom of the structural core so that the panel overlays and is bonded to the peripheral flange of the structural core and to the bottom walls of the longitudinally extending channels formed in the structural support core. As before, bonding of the second and third panels can be accomplished by any number of means well known to those skilled in the art such as adhesive bonding, sonic weldment, and like techniques.

In the case of the surfboard in FIGS. 15 through 23 and the case of the sailboard of FIGS. 24 through 29, after the structural core is constructed and before the upper and lower panels are affixed thereto, the fin blocks or the mast box, as the case may be, is adhesively bonded to the structural core.

While the various dimensions of the surfboard construction, as shown in FIGS. 15 through 23, vary according to intended end use, the structural reinforcement core 12 is preferably formed from a sheet of ABS having a thickness of on the order of 0.125 inches. Similarly, top sheet 42 preferably has a thickness of about 0.040 while bottom sheet 44 has a thickness of about 0.060. Support surfaces 86, 88, and 90 are preferably on the order of about 3½ inches in width while channels 80, 82, and 84 are on the order of about ½ inches wide. For best performance, the maximum thickness of the forward section 14 of the surfboard is on the order of two inches. With respect to the sailboard construction shown in FIGS. 24 through 28, the width of support surfaces 132 is on the order of 5 inches and the width of channel 130 is on the order of ½ inch wide. Preferably the thickness of the sailboard is about 5 inches. However, it is to be understood that these dimensions can vary depending on the end use to be made of the sailboard.

With respect the body board construction shown in FIGS. 31 through 34, the width of the upper support surfaces and the channels is basically the same as those of the surfboard of FIGS. 15 through 23. However, since the core of the body board comprises structural cores 164*a* and 164*b* bonded together in a back-to-back relationship, the thickness of the body board is on the order of 4 inches. The method of making the body board is similar in most respects to the method of making the surfboard and sailboard. For example, the structural cores are vacuum formed in the same general manner as described in the preceding paragraphs. Similarly, second upper panel 190 is formed substantially in the manner described to form the downwardly curved margins 195 and the inturned flanges 196. However, the lower panel 192 of the body board, rather than being planar, is heated and formed so as to also have a central portion surrounded by a curved margin 195 terminating in an inturned flange portion 196 generally identical in configuration to the second upper panel. Once the structural cores 164*a* and 164*b* are formed in the configuration shown in FIG. 34, they then are placed back-to-back and the peripheral flanges 196 thereof, as well as the base surfaces of the channels 166*c*, 168*c* and 170*c*, are bonded together to form a double thickness structural core of the character shown in FIG. 34. This done, the upper and lower strategically shaped panels 190 and 192 are placed over the double core and the inturned flange portions of each are bonded to the flange portions of the structural cores. At the same time, the central portion of the upper and lower panels are bonded to the surfaces of the structural cores which are disposed between the channels thereof.

It is to be understood that the dimensions of the various forms of the flotation devices of the invention as set forth in the foregoing paragraphs are for illustration purposes only and in no way restrict the actual configuration of the devices made in accordance with the methods of the present invention.

Figure 36:
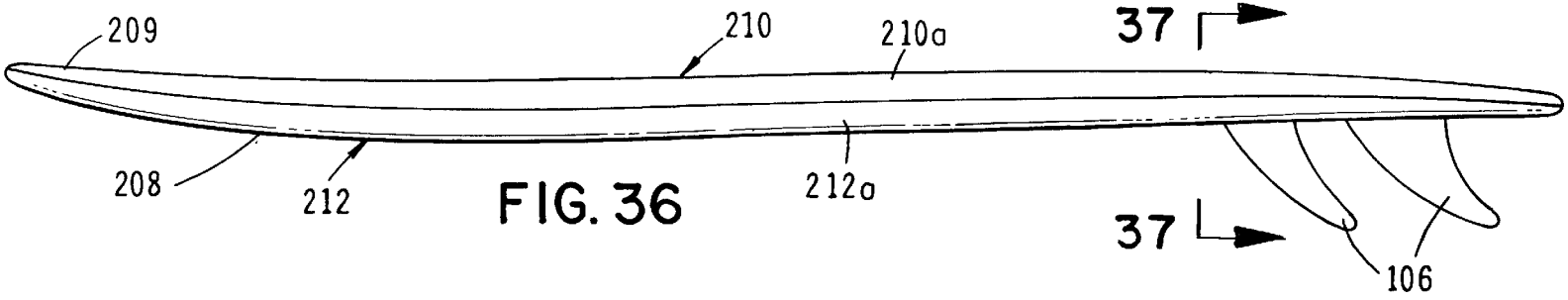
FIG. 36 is a side-elevational view of still another form of the invention.
Figure 37:
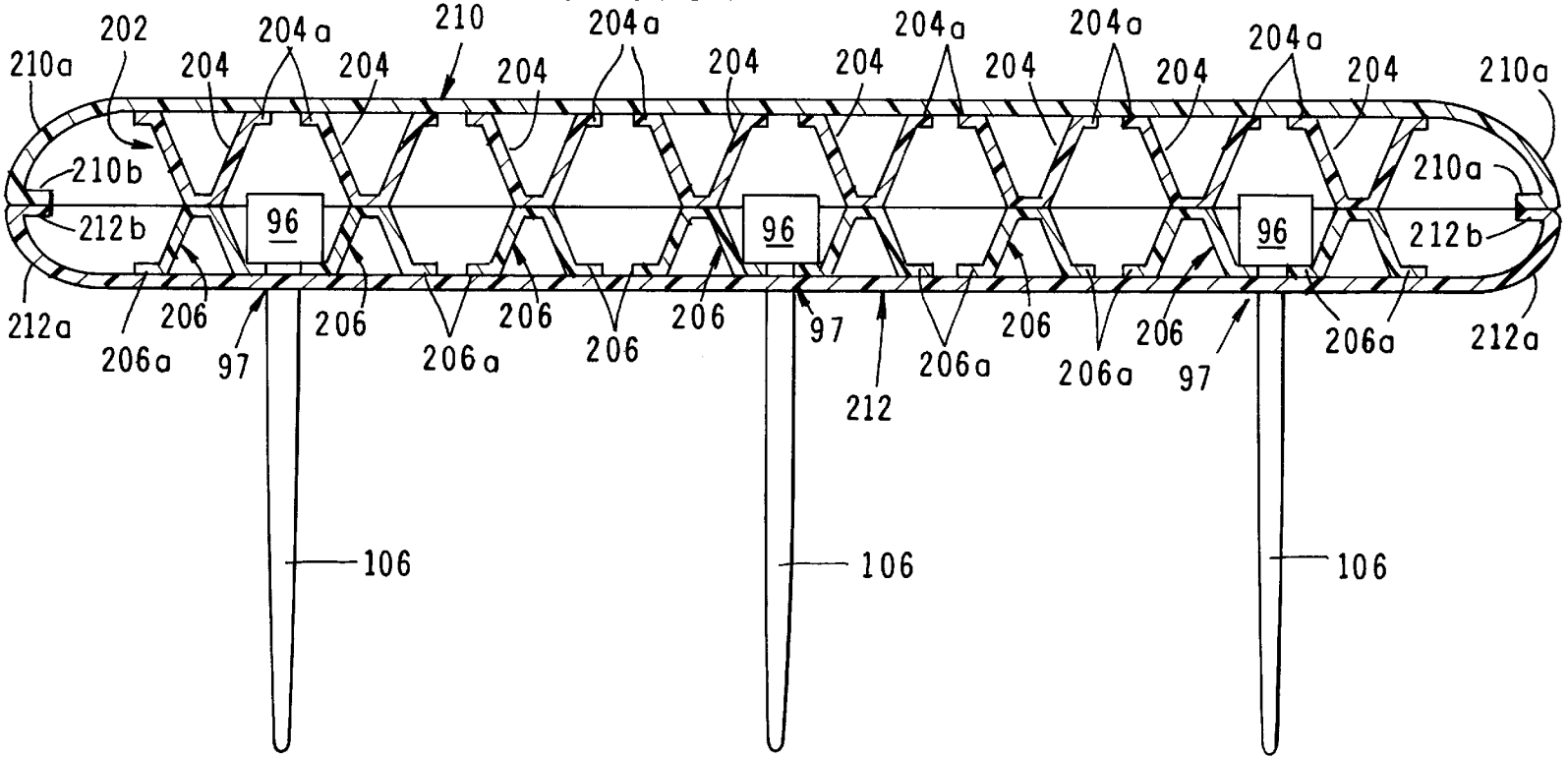
FIG. 37 is an enlarged, cross-sectional view taken along lines 37—37 of FIG. 36.

Before discussing an alternate form of flotation device of the invention, which uniquely is motorized, yet another form of surfboard construction is shown in FIGS. 36 and 37. This form of surfboard construction comprises a structural reinforcing core 202 of a substantially different construction from that shown in FIGS. 1 through 14. More particularly, the reinforcing core here comprises a plurality of transversely spaced-apart, longitudinally extending, generally "V" shaped upper reinforcing ribs 204 which are bonded together in a back-to-back relationship with a plurality of transversely spaced-apart, longitudinally extending, generally "V" shaped lower reinforcing ribs 206. Each of the ribs 204 and 206 is provided with outwardly extending feet 204*a* and 206*a* each of which provide panel engaging surfaces. As best seen in FIG. 37, ribs 204 are of a height somewhat greater than the height of the ribs 206.

As best seen in FIG. 36, forward section 208 of the surfboard there shown is upturned and terminates in a forward bow portion 209. Overlaying and bonded to the panel engaging surfaces of feet 204*a* and ribs 204 is a first or upper panel 210. Upper panel 210 is provided with a downwardly curved, peripheral portion 210*a* which terminates in a inturned flange 210*b*. In similar fashion, a second or lower panel 212 overlays the panel engaging surfaces of feet 206*a* of ribs 206. Lower panel 212 is of similar construction to upper panel 210 and includes a downwardly curved, peripheral portion 212*a* which terminates in an inturned flange 212*b*. As indicated in FIG. 37, the inturned flanges 210*b* and 212*b* are bonded together so as to encapsulate the core assembly made up of ribs 204 and 206. Because ribs 206 are of a lesser height than ribs 204, panel 212 is also of a lesser height than panel 210.

As before, bottom panel 212 is provided with a plurality of longitudinally extending, transversely spaced-apart fin receiving openings which index with block-receiving cavities defined between the centrally disposed ribs 206. Receivable within these openings for interconnection with fin blocks 96 of the character previously described, are a plurality of fins 106 of conventional configuration. Blocks 96 and fins 106 which together comprise the fin assemblies 97 of the invention, are of a character well known in the art and are commercially available from sources such as the Chinook Company of Hood River, Oreg.

Figure 35:
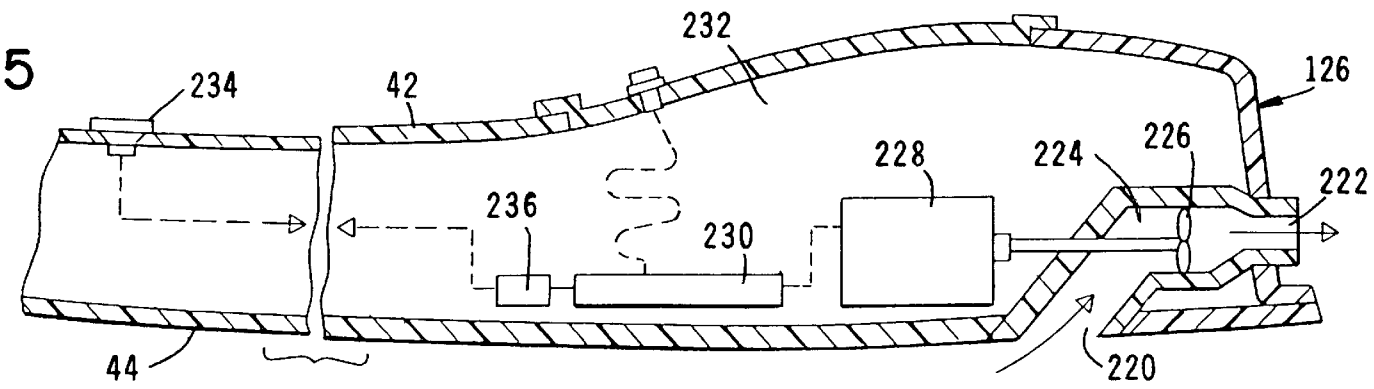
FIG. 35 is a fragmentary, cross-sectional view of the rear portion of a flotation device of the present invention which device includes motor means for propelling the flotation device through the water.

Turning lastly to FIG. 35, still another form of the flotation device of the invention is there illustrated. This device is a construction similar to that shown in FIGS. 1 and 10 and is constructed in general accordance with the methods previously described herein. However, the stern portion 126 of the device has been modified to provide a water inlet 220, a water outlet 222, and an intermediate flow chamber 224. Disposed within flow chamber 224 is a propeller 226 which is rotated by motor means comprising a motor 228. Motor 228, as well as propeller 226, form a part of the propelling means of the invention for propelling the flotation device through the water. Motor 228 is of a conventional construction well known to those skilled in the art and is powered by a rechargeable battery 230 housed within chamber 232 formed in the stern portion of the device.

The object of the propelling means is to give the surfer a times interval of thrust which supplements his propelling efforts. The propelling means is actuated by a start button, or switch 234, which is connected to a timer 236 which provides a 5–10 second thrust before automatically de-energizing the motor

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A flotation device comprising:

(a) a structural reinforcing core comprising a first panel constructed of a formable plastic material, said core including a central portion having transversely spaced-apart, longitudinally extending upper surfaces with a longitudinally extending channel disposed between said spaced-apart, longitudinally extending upper surfaces, said channel being defined by spaced-apart side walls and a bottom wall, said structural reinforcing core further including a peripheral flange surrounding said central portion;

(b) a second, upper panel constructed of a formable plastic material having a downwardly curved peripheral portion terminating in an inturned flange, said second upper panel overlaying said structural reinforcing core and being affixed to, said peripheral flange and to said transversely spaces apart upper surfaces of said reinforcing core and;

(c) a third lower panel overlaying and being affixed to at coast said inturned flange of said upper panel and to said bottom wall and to said peripherial flange of said structural core.

2. A flotation device as defined in claim 1 in which said downwardly curved peripheral portion of said second, upper panel is generally "C" shaped in cross section.

3. A flotation device as defined in claim 1 in which said structural reinforcing core further includes an upraised forward portion.

4. A flotation device comprising:

(a) a first structural reinforcing core comprising a first panel sheet of formable plastic material, said core having an upwardly curved forward portion and including spaced-apart, longitudinally extending upper surfaces and a peripheral flange having upper and lower spaced-apart surfaces;

(b) a second, upper panel overlaying and affixed to said upper surfaces of said core, said second upper panel having a downwardly curved peripheral portion terminating in an inturned flange bonded to said upper surfaces of said peripheral flange of said structural reinforcing core; and (c) a third lower panel overlaying and affixed to said structural reinforcing core.

5. A flotation device as defined in claim 4 in which said structural reinforcing core is provided with a longitudinally extending channel disposed between said upper surfaces.

6. A flotation device as defined in claim 5 further including a second structural reinforcing core disposed between said first structural reinforcing core and said third lower panel.

7. A flotation device as defined in claim 5 in which said channel is generally "U" shaped in cross section, and includes generally vertically extending side walls interconnected by a base wall, said third lower panel being affixed to said base wall.

8. A flotation device as defined in claim 5 further including at least one fin connected to said structural reinforcing core.

9. A flotation device as defined in claim 5 further including a mast box affixed to said structural reinforcing core.

10. A flotation device comprising:

(a) a structural reinforcing core constructed from a first panel of formable plastic material, said core having an upturned forward portion, a central portion and a pair of longitudinally extending, transversely spaced-apart upper surfaces, said core further including:

(i) a peripheral flange surrounding said central portion, said flange having an upper surface and a lower surface; and (ii) at least one generally "U" shaped channel, said channel having spaced-part side walls connected to a bottom wall;

(b) a second, upper panel having a downwardly curved generally "C" shaped peripheral portion, said second upper panel overlaying and being affixed to said pair of longitudinally extending upper surfaces and to said upper surface of said peripheral flange of said structural reinforcing core; and (c) a third lower panel overlaying and affixed to said bottom wall of said channel and to said lower surface of said peripheral flange of said structural reinforcing core.

11. A flotation device as defined in claim 10 in which said structural reinforcing core further includes at least one fin block receiving cavity and in which said flotation device includes at least one fin assembly including a fin block receivable within said fin block receiving cavity.

12. A flotation device as defined in claim 10 in which said structural reinforcing core includes a mast block disposed within said channel and in which said second upper panel includes a longitudinally extending opening superimposed over said mast block.

13. A flotation device as defined in claim 10 further including propelling means disposed intermediate said second, upper panel and said third lower panel for propelling said flotation device through the water.

14. A flotation device as defined in claim 13 in which said propelling means comprises an electric motor.

15. A method of making a flotation device comprising the steps of:

(a) raising the temperature of a sheet of plastic material to an elevated temperature to form a first heated panel;

(b) forming from said first heated panel a structural core having an upturned forward portion, a central portion having a pair of spaced-apart upper surfaces and a marginal flange portion surrounding said central portion and spaced apart from said upper surfaces;

(c) raising the temperature of a second sheet of plastic to form a second heated panel;

(d) forming from said second heated panel a shaped upper panel having a central portion and a curved marginal portion surrounding said central portion, said curved marginal portion terminating in an inturned flange;

(e) placing said shaped upper panel over said structural core and bonding said inturned flange thereof to said flange of said structural core; and (f) emplacing a third plastic sheet over said structural core and bonding said third plastic sheet to said flange portion of said structural core.

16. A method as defined in claim 15 including the further step of bonding said shaped upper panel to said upper surfaces of said structural core.

17. A method as defined in claim 15 including the further step of forming said first heated panel into a structural core further having a longitudinally extending channel disposed between said upper surfaces, said channel having side walls connected to a lower base wall.

18. A method as defined in claim 17 including the further step of bonding said third plastic sheet to said lower base wall of said channel of said structural core.

* * * * *